US010143882B2

(12) United States Patent
Lagree

(10) Patent No.: US 10,143,882 B2
(45) **Date of Patent: *Dec. 4, 2018**

(54) EXERCISE MACHINE WITH MULTIPLE CONTACT SURFACES

(71) Applicant: Lagree Technologies, Inc., Burbank, CA (US)

(72) Inventor: Sebastien Anthony Louis Lagree, Burbank, CA (US)

(73) Assignee: Lagree Technologies, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/989,669

(22) Filed: May 25, 2018

(65) Prior Publication Data

US 2018/0272179 A1 Sep. 27, 2018

Related U.S. Application Data

(63) Continuation of application No. 15/299,333, filed on Oct. 20, 2016, now Pat. No. 9,981,156.
(Continued)

(51) Int. Cl.
*A63B 26/00* (2006.01)
*A63B 21/00* (2006.01)
(Continued)

(52) U.S. Cl.
CPC ..... *A63B 21/4035* (2015.10); *A63B 21/4034* (2015.10); *A63B 21/4045* (2015.10); *A63B 22/0023* (2013.01); *A63B 22/0087* (2013.01); *A63B 23/03525* (2013.01); *A63B 23/0405* (2013.01); *A63B 23/1209* (2013.01); *A63B 21/023* (2013.01); *A63B 21/0552* (2013.01); *A63B 21/068* (2013.01); *A63B 23/0211* (2013.01); *A63B 23/0216* (2013.01);
(Continued)

(58) Field of Classification Search
CPC ..... A63B 21/1465; A63B 21/1469
See application file for complete search history.

(56) References Cited

U.S. PATENT DOCUMENTS 1,866,868 A 7/1932 Thomson
2,733,922 A 2/1956 Diego
(Continued)

OTHER PUBLICATIONS

PCT International Search Report and Written Opinion for PCT/US2016/58178; dated Jan. 13, 2017.
(Continued)

*Primary Examiner* — Loan H Thanh
*Assistant Examiner* — Rae Fischer
(74) *Attorney, Agent, or Firm* — Neustel Law Offices

(57) ABSTRACT

An exercise machine with multiple contact surfaces for providing secondary exercise support platforms positioned at various planes relative to the horizontal plane of the primary exercising platforms, the secondary platforms further serving as handles used during the performance of exercises. The exercise machine with multiple contact surfaces generally includes a frame, a carriage movably attached to the rail, and a first support structure and a second support structure attached to the frame near the first end. The support structures each include one or more platforms having an upper surface that is positioned above the base plane of the carriage.

56 Claims, 13 Drawing Sheets

Related U.S. Application Data

(60) Provisional application No. 62/244,275, filed on Oct. 21, 2015.

(51) Int. Cl.

| | |
|---|---|
| ***A63B 22/00*** | (2006.01) |
| ***A63B 23/035*** | (2006.01) |
| ***A63B 23/04*** | (2006.01) |
| ***A63B 23/12*** | (2006.01) |
| *A63B 23/02* | (2006.01) |
| *A63B 21/055* | (2006.01) |
| *A63B 21/068* | (2006.01) |
| *A63B 21/02* | (2006.01) |

(52) U.S. Cl.

CPC ... *A63B 23/0233* (2013.01); *A63B 2208/0219* (2013.01); *A63B 2208/0247* (2013.01); *A63B 2208/0252* (2013.01); *A63B 2208/0295* (2013.01)

(56) References Cited

U.S. PATENT DOCUMENTS

| | | | | |
|---|---|---|---|---|
| 3,770,267 | A | 11/1973 | McCarthy | |
| 4,620,701 | A | 11/1986 | Mojden | |
| 4,706,953 | A | 11/1987 | Graham | |
| 4,759,540 | A | 7/1988 | Yu | |
| 4,798,378 | A | 1/1989 | Jones | |
| 4,845,987 | A | 7/1989 | Kenneth | |
| 5,066,005 | A | 11/1991 | Luecke | |
| 5,179,746 | A | 1/1993 | Rogers | |
| 5,263,913 | A | 11/1993 | Boren | |
| 5,885,197 | A | 3/1999 | Barton | |
| 6,042,523 | A | 3/2000 | Graham | |
| 6,179,753 | B1 | 1/2001 | Barker | |
| 6,461,283 | B1 | 10/2002 | Maron | |
| 7,163,500 | B2 | 1/2007 | Endelman | |
| 7,803,095 | B1 | 9/2010 | Lagree | |
| 7,938,763 | B2 * | 5/2011 | Campanaro | A63B 21/068 482/140 |
| D659,205 | S | 5/2012 | Endelman | |
| 8,613,692 | B2 | 12/2013 | Baudhuin | |
| 8,641,585 | B2 * | 2/2014 | LaGree | A63B 21/023 482/92 |
| 9,119,989 | B1 * | 9/2015 | Lagree | A63B 21/4001 |
| 2001/0056011 | A1 | 12/2001 | Endelman | |
| 2003/0119635 | A1 | 6/2003 | Arbuckle | |
| 2006/0199712 | A1 | 9/2006 | Barnard | |
| 2008/0248935 | A1 | 10/2008 | Solow | |
| 2009/0118108 | A1 | 5/2009 | Uygan | |
| 2010/0227748 | A1 | 9/2010 | Campanaro | |
| 2011/0166002 | A1 | 7/2011 | Saysek | |
| 2011/0172069 | A1 | 7/2011 | Gerschefske | |
| 2012/0295771 | A1 | 11/2012 | Lagree | |
| 2013/0281269 | A1 | 10/2013 | Gerschefske | |
| 2014/0011645 | A1 | 1/2014 | Johnson | |
| 2014/0121076 | A1 | 5/2014 | Lagree | |
| 2014/0121078 | A1 | 5/2014 | Lagree | |
| 2014/0121079 | A1 | 5/2014 | Lagree | |
| 2014/0141948 | A1 | 5/2014 | Aronson | |
| 2015/0024914 | A1 | 1/2015 | Lagree | |
| 2015/0057127 | A1 | 2/2015 | Lagree | |
| 2015/0065318 | A1 | 3/2015 | Lagree | |
| 2015/0072841 | A1 | 3/2015 | Lagree | |
| 2015/0141204 | A1 | 5/2015 | Lagree | |
| 2015/0217164 | A1 | 8/2015 | Lagree | |
| 2015/0220523 | A1 | 8/2015 | Lagree | |
| 2015/0246263 | A1 | 9/2015 | Campanaro | |
| 2015/0297944 | A1 | 10/2015 | Lagree | |
| 2015/0343250 | A1 | 12/2015 | Lagree | |
| 2015/0360068 | A1 | 12/2015 | Lagree | |
| 2015/0360083 | A1 | 12/2015 | Lagree | |
| 2015/0360113 | A1 | 12/2015 | Lagree | |
| 2015/0364058 | A1 | 12/2015 | Lagree | |
| 2015/0367166 | A1 | 12/2015 | Lagree | |
| 2016/0008657 | A1 | 1/2016 | Lagree | |
| 2016/0059060 | A1 | 3/2016 | Lagree | |
| 2016/0059061 | A1 | 3/2016 | Lagree | |
| 2016/0096059 | A1 | 4/2016 | Lagree | |
| 2016/0166870 | A1 | 6/2016 | Lagree | |
| 2016/0193496 | A1 | 7/2016 | Lagree | |
| 2016/0256733 | A1 | 9/2016 | Lagree | |
| 2016/0271452 | A1 | 9/2016 | Lagree | |

OTHER PUBLICATIONS https://twitter.com/LagreeFitness/status/635822521997242369; "Can you handle the Supraformer?"(@LAGREEFITNESS) Twitter Post; Aug. 24, 2015.

https://twitter.com/LagreeFitness/status/636555280218615808; "Los Angeles: Get ready for a one of kind workout!" (@LAGREEFITNESS) Twitter Post; Aug. 26, 2015.

* cited by examiner

EXERCISE MACHINE WITH MULTIPLE CONTACT SURFACES

CROSS REFERENCE TO RELATED APPLICATIONS

The present application is a continuation of U.S. application Ser. No. 15/299,333 filed on Oct. 20, 2016 which issues as U.S. Pat. No. 9,981,156 on May 29, 2018, which claims priority to U.S. Provisional Application No. 62/244,275 filed Oct. 21, 2015. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine with multiple contact surfaces for providing secondary exercise support platforms positioned at various planes relative to the horizontal plane of the primary exercising platforms, the secondary platforms further serving as handles used during the performance of exercises.

Related Art

Any discussion of the related art throughout the specification should in no way be considered as an admission that such related art is widely known or forms part of common general knowledge in the field.

Pilates machines, also referred to as Pilates apparatuses comprise a substantially rectangular structure with a pair of horizontally oriented rails extending substantially the length of structure parallel to the longitudinal axis of the structure. An exercise platform with a top surface aligned with the horizontal plane is slidably affixed to the rails. One or more extension springs are removably attached between a first end of the longitudinal structure and the slidable platform, thereby creating a resistance bias towards the first end of the structure against which an exerciser positioned upon the platform must overcome in order to move the slidable platform towards the second end. This is a well-known form of resistance exercising. The slidable platform is also referred to as a carriage.

One adaptation of conventional Pilates machines has been the addition of a cross bar positioned substantially at the first end of the structure, aligned crosswise to the longitudinal axis of the apparatus. This cross bar is typically used as a fixed position handle against which an exerciser may push or pull against as an aid to performing an exercise. The cross bar on conventional Pilates machines is used as a handle is typically a round elongated bar used as a hand-grab or foot press. One example of a cross bar is illustrated in U.S. Pat. No. 7,803,095 to Lagree.

One major problem of the crossbar on Pilates machines is that the crossbar is not designed to support the weight of an exerciser since it is used for push and pull type exercises. Another problem with the crossbar is that the cross sectional dimension is substantially small, for instance, a one-inch diameter bar, and does not provide for a large surface area against which an exerciser can comfortably push against with bare feet. The small bar will cause pain, and inherently inhibits an exerciser from maximizing the exercise resistance for the workout because of the foot pain caused by the increased resistance force.

Another problem is that the cross bar is intended to be used when an exerciser is substantially positioned upon the slidable carriage with their shoulders substantially parallel to the cross bar. In other words, an exerciser may be kneeling on the carriage while facing the cross bar, thereby allowing the exerciser to grab the bar with both hands, may be positioned on their back with both feet pressing against the cross bar, or may be positioned on their back on the carriage with their feet distal to the cross bar, and their hands reaching over their head to grab the bar.

The problem just described may be immediately appreciated by those skilled in the art when an exercise calls for an exerciser to be positioned on slidable carriage lying on their side, with one foot pressing against the cross bar. As can be understood, in this position, the length of the foot is aligned parallel to the longitudinal axis of a narrow cross bar. In such instances, the foot, having an extremely small surface against which to push, may slip off of the cross bar causing injury, or at the least, causing the exerciser to stop exercising. In most all cases, the alignment of the length of the foot against the longitudinal axis of the narrow cross bar will cause the exerciser foot pain throughout the foot-pressing exercise.

Yet another problem with the cross bar as just described is that the height of the cross bar is typically positioned at a fixed dimension above the primary horizontal plane of the slidable platform. Since the height of people who exercise vary significantly for instance, the shorter exercisers perhaps being under five feet in height, and the taller exercisers being up to seven feet in height, the substantially fixed position of the cross bar fails to provide ergonomically correct positioning of all exercisers.

SUMMARY

An example embodiment of the present invention is directed to an exercise machine with multiple contact surfaces. The exercise machine with multiple contact surfaces includes a plurality of resting platforms fixed at various dimensions vertically positioned above the horizontal plane of the slidable carriage of a Pilates apparatus. The plurality of platforms thereby provide for surfaces providing for grasping by the hands, supporting the exercisers' arms, resistant to pushing force applied by exercisers' feet or supportive of the entire weight of an exerciser upon the apparatus, and which further provides for ergonomically correct hand-gripping positions used by all different sized exercisers when performing various exercises upon the apparatus.

The width of the handle platforms are preferably of a dimension that provides for comfortable gripping by the exerciser's hands, while at the same time provides for comfortably cushioning exercisers who apply substantial downward or lateral force against the platform by distributing such forces to an adequately large platform surface area upon which a hand, arm, foot or entire body weight is placed.

More specifically, the present invention teaches an exercise apparatus with a plurality of exercise support platforms that also serve as grasping handles, the handles providing for an exerciser to grip the handles when the palms of their hands are facing vertically upward, downward, or facing toward or away from the central longitudinal axis of the apparatus.

It should be noted that for illustrative purposes, the description herein may refer to the longitudinal axis of the apparatus as a "Y axis", the axis lateral to the longitudinal axis as the "X axis", and the vertical axis with a zero elevation dimension being the horizontal plane of the slidable carriage platform as a "Z axis".

One exemplary embodiment of the present invention is a handle system of an exercise apparatus with at least one secondary support platform to support the hands, arms or feet of an exerciser, the secondary support platform creating an exercise surface on a second horizontal plane positioned at a fixed Z dimension above the primary horizontal plane of the slidable exercise platform.

Another exemplary embodiment of the present invention is a handle system of an improved exercise apparatus, the handles preferably comprising a substantial horizontal surface area that serve as a secondary support platforms positioned at fixed Z dimensions above the primary slidable carriage platform.

Another exemplary embodiment of the present invention is a handle system of an improved exercise apparatus, the handle system being constructed of a conformable material that provides distributed force cushioning when used as a support platform, and provides for adequate conformability when squeezed by the hand when used as a gripping handle.

Yet another exemplary embodiment of the present invention is a handle of an improved exercise apparatus, the substantially horizontal top surface of the platform usable as a handle for easy gripping by a hand with the palm facing vertically downward, and a substantially vertically aligned portion of the platform of sufficient surface area as to provide for supporting substantially the entire foot of an exerciser pressing horizontally upon the handle with their foot.

Still another exemplary embodiment of the present invention is a handle system of an improved exercise apparatus, the handles providing a plurality of gripping surfaces including substantially horizontal gripping surfaces with the central axis of the handles being substantially aligned with the X axis of the apparatus, substantially horizontal gripping surfaces with the central axis of the handles being substantially aligned with the Y axis of the apparatus, substantially vertical gripping surfaces with the central axis of the handles being substantially aligned with the Z axis at various dimensions above the horizontal plane of the primary slidable carriage platform, and substantially vertical gripping surfaces with the central axis of the handles being positioned at acute angles relative to the Z axis.

Another exemplary embodiment of the present invention is a substantially vertical platform used as a foot press, the platform preferably comprising a height and width dimension providing for support of substantially the entire bottom of an exerciser's foot whether the foot is vertically or horizontally positioned upon the platform.

Still another exemplary embodiment of the present invention is a platform handle system comprising vertically projecting stanchions affixed to the support structure of an exercise apparatus, and a plurality of substantially vertical and horizontal gripping handles and supporting surfaces at different positions so as to accommodate all sizes of exercisers performing new exercises that cannot be performed on traditional Pilates apparatuses absent an equivalent platform handle system.

These and other embodiments will become known to one skilled in the art, especially after understanding the significant commercial advantages of an improved exercise apparatus that provides for the execution of exercises that cannot be performed on traditional Pilates apparatuses, and that accommodate all sizes of exercisers who will grip the particular handles most ergonomically preferred, or support their bodies upon one or more support platforms while performing an expanded repertoire of exercises that cannot be performed on traditional Pilates apparatuses. The present invention is not intended to be limited to the disclosed embodiments.

There has thus been outlined, rather broadly, some of the features of the exercise machine with multiple contact surfaces in order that the detailed description thereof may be better understood, and in order that the present contribution to the art may be better appreciated. There are additional features of the exercise machine with multiple contact surfaces that will be described hereinafter and that will form the subject matter of the claims appended hereto. In this respect, before explaining at least one embodiment of the exercise machine with multiple contact surfaces in detail, it is to be understood that the exercise machine with multiple contact surfaces is not limited in its application to the details of construction or to the arrangements of the components set forth in the following description or illustrated in the drawings. The exercise machine with multiple contact surfaces is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows. All distances and lengths using specific measurements are approximations only and are not limited to the specific measurement indicated and should be interpreted to include any measurement reasonably adjacent or near the stated measurement.

"Platform" as used herein may also mean supporting surface upon which an exerciser can place all or part of their body during the performance of an exercise. The platform may have a supporting surface that is aligned substantially with the horizontal surface of the primary exercise platform plane, perpendicular to the primary exercise platform plane, or positioned angularly relative to the primary horizontal surface of the primary exercise platform plane. These descriptions are interchangeable. "Platform" as used herein may also mean supporting surface upon which an exerciser can place all or part of their body during the performance of an exercise. "Handle" as used herein may also mean a hand-graspable platform of such length to width ratio so as to be easily grasped by an exerciser's hand, thereby providing for a gripping. References to a "Y axis" as used herein shall mean the axis of the longitudinal center of the exercise apparatus. References to "X axis" as used herein shall mean the horizontal axis perpendicular to the Y axis. References to "Z axis" as used herein shall mean the vertical axis with a zero point located upon the Y axis, and a positive dimension being a distance measured above the Y axis.

An example exercise machine with multiple contact surfaces generally comprises a frame 200, a carriage 103 movably attached to the rail 100, and a first support structure 300*a* and a second support structure 300*b* attached to the frame 200 near the first end. The support structures 300*a*, 300*b* each include one or more platforms 108*a*, 108*b* having an upper surface that is positioned above the first plane P1 of the carriage.

Figure 1:
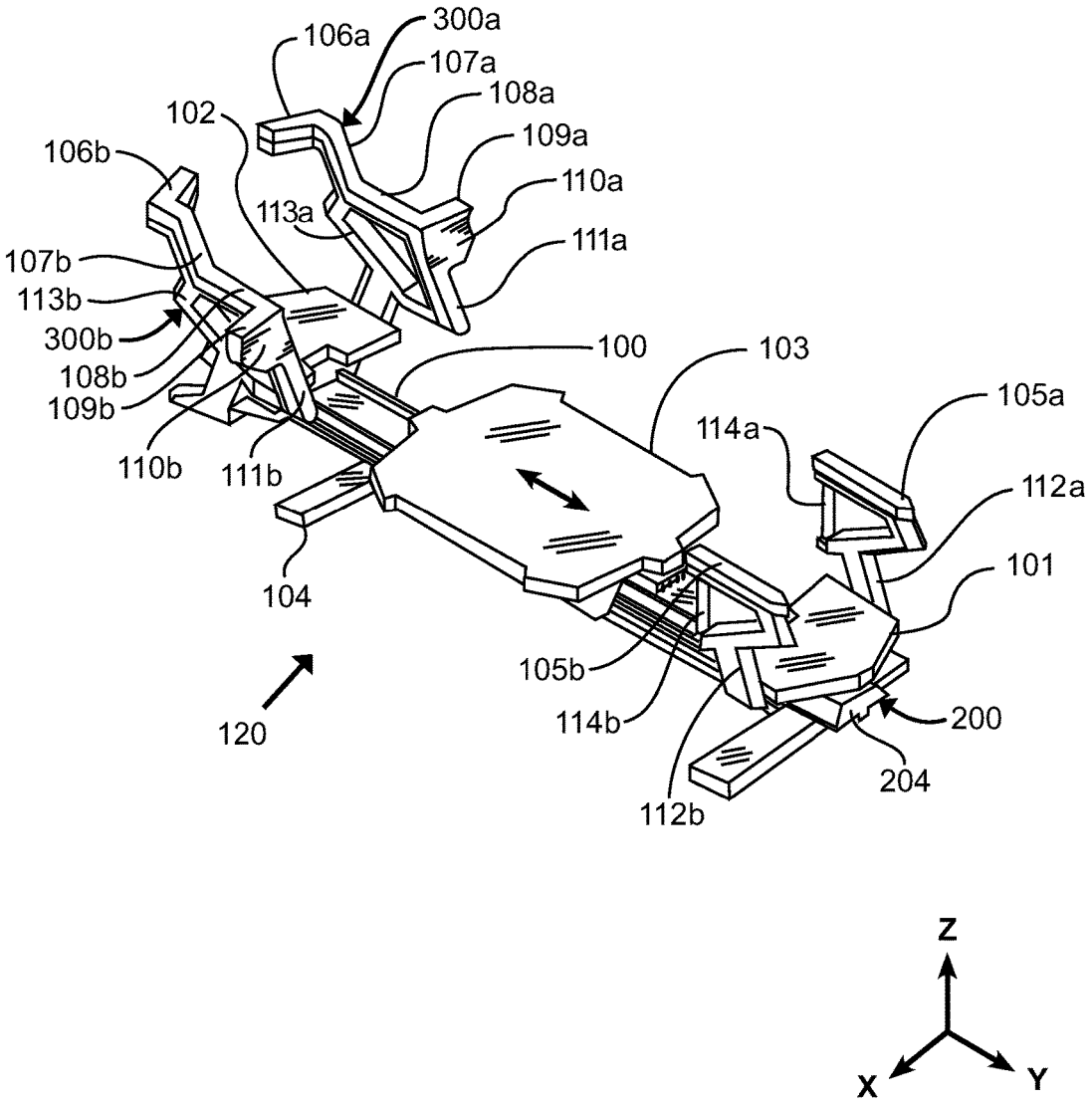
FIG. 1 is an exemplary diagram showing an isometric view of an exercise apparatus with an improved platform handle system in accordance with an example embodiment.

As shown in an embodiment of the invention in FIG. 1, the exercise machine generally comprises a substantially longitudinal rail structure 100 supported by a plurality of feet 104, a first stationary platform 102 substantially at a first end, a second stationary platform 101 positioned substantially at a distal second end, and a slidable carriage 103 slidably attached to the rail structure 100, and slidable substantially the length of the apparatus between the first and second stationary platforms. The rail structure 100 may be comprised of a single monorail structure as illustrated in the drawings or two parallel rails.

Not shown, but contained within the interior of the rail structure 100, one or more biasing members (e.g. springs, elastic cords) are removably attachable between a first end of the apparatus and the slidable carriage, thereby exerting a biasing force on the carriage. An exerciser performs resistance exercises on the apparatus by moving the carriage in a direction opposed to the biasing members. U.S. Pat. No. 7,803,095 to Lagree illustrates an exemplary exercise apparatus suitable for use as the base structure for the present invention and is hereby incorporated by reference in its entirety herein.

In the drawing, a supporting base with feet 104 is shown supporting an exercise apparatus. A first stationary platform 102 is shown positioned between a pair of stanchions 113*a*, 113*b* that support a plurality of supporting platforms and handles.

A plurality of secondary support platforms and gripping handles are shown, specifically a left and right platform and handle system 105*a*, 105*b* positioned substantially at the second end of the apparatus. A plurality of secondary support platforms and gripping handles are shown, specifically a left and right platform and handle system 105*a*, 105*b* positioned substantially at the second end of the apparatus the platform and handle systems supported by stanchions 112*a*, 112*b* affixed to the support structure.

Further, a left and right platform and handle system 300*a*, 300*b* substantially positioned at the first end of the apparatus, each handle system 300*a*, 300*b* comprising an upper horizontal platform and handle 106*a*, 106*b*, an upper gripping handle 107*a*, 107*b* angled downwardly at an acute angle to the Z axis, a lower horizontal platform and handle 108*a*, 108*b* aligned with the Y axis, a lower handle 109*a*, 109*b* extending laterally therefrom substantially aligned with the X axis, a leg press platform 110*a*, 110*b*, and a lower gripping handle 111*a*, 111*b* aligned at an acute angle to the Z axis.

More specifically, the platform handle assemblies comprise an upper horizontal platform and handle 106*a*, 106*b* projecting substantially medially towards the longitudinal center line and substantially aligned with the X axis, a lower handle 109*a*, 109*b* extending laterally therefrom substantially aligned with the X axis, and a leg press platform 110*a*, 110*b* projecting laterally therefrom substantially aligned with the X axis.

Figure 2:
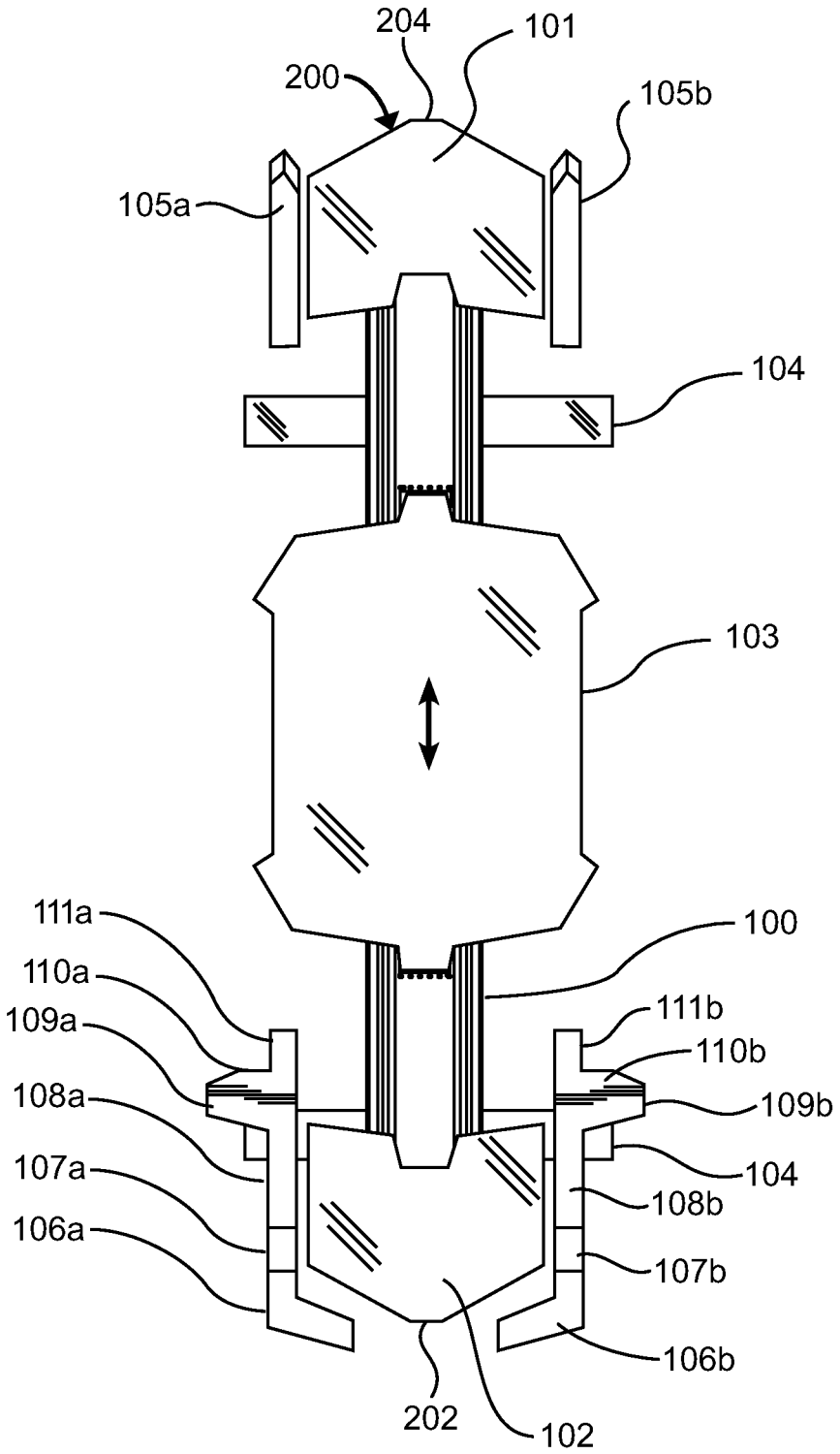
FIG. 2 is an exemplary diagram showing a top view of an exercise apparatus with an improved platform handle system.

FIG. 2 is an exemplary diagram showing a top view of an exercise apparatus with an improved platform handle system. More specifically, an exercise apparatus 120 is shown comprising a substantially longitudinal rail structure 100 supported by a plurality of feet 104, a first stationary platform 102 substantially at a first end, a second stationary platform 101 positioned substantially at a distal second end, and a slidable carriage 103 slidably attached to the support structure by means of a plurality of trolley wheels not shown, and slidable substantially the length of the apparatus between the first and second stationary platforms.

A left and right platform and handle system substantially positioned at the first end of the apparatus, each handle system comprising an upper horizontal platform and handle 106*a*, 106*b*, an upper gripping handle 107*a*, 107*b* angled downwardly at an acute angle to the Z axis, a lower horizontal platform and handle 108 aligned with the Y axis, a lower handle 109*a*, 109*b* extending laterally therefrom substantially aligned with the X axis, a leg press platform 110*a*, 110*b*, and a lower gripping handle 111*a*, 111*b* aligned at an acute angle to the Z axis.

Figure 3:
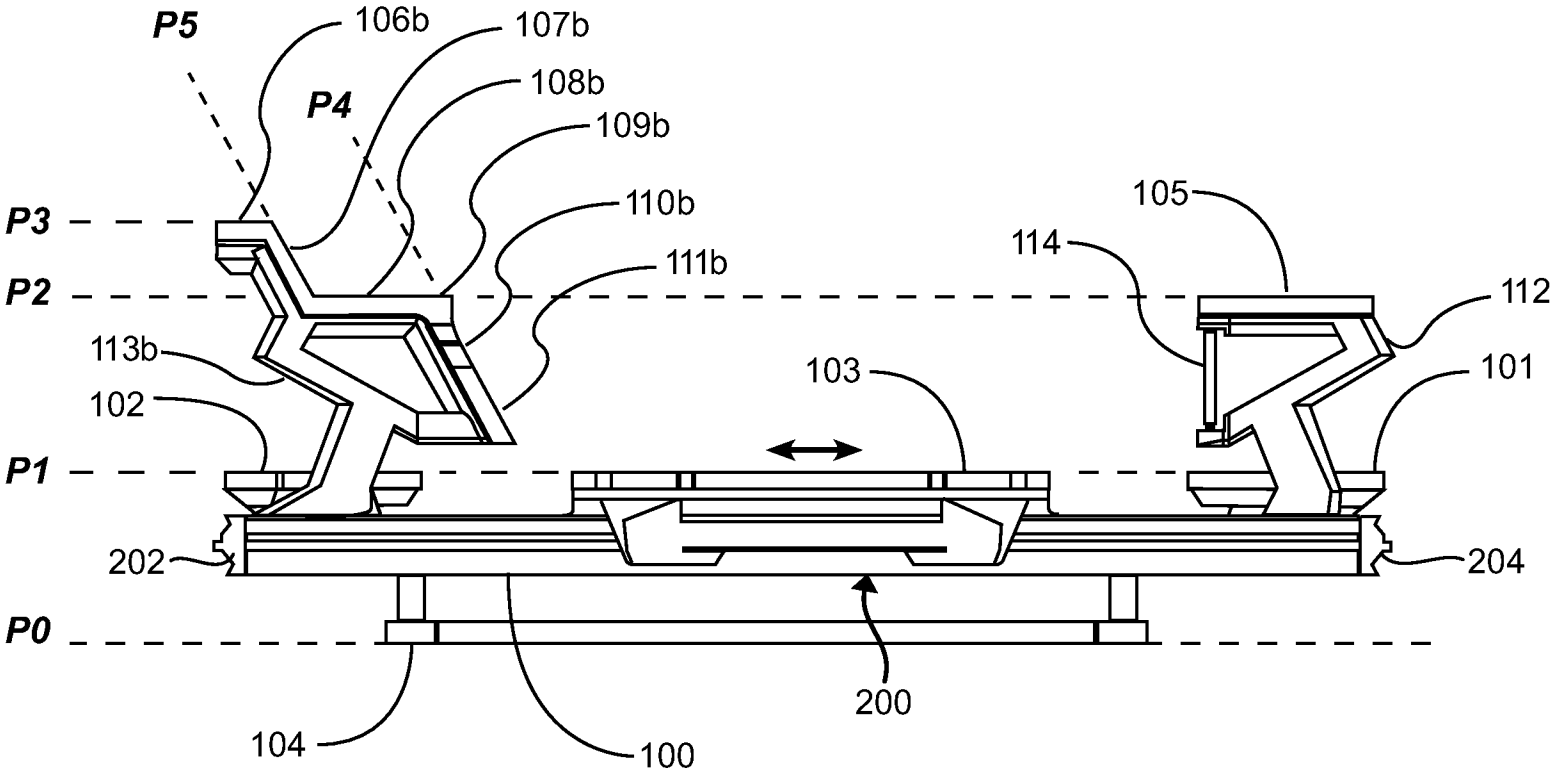
FIG. 3 is an exemplary diagram showing a side view of an exercise apparatus with an improved platform handle system.

FIG. 3 is an exemplary diagram showing a side view of an exercise apparatus with an improved platform handle system. A plurality of secondary support platforms and gripping handles are shown, specifically a left and right platform and handle system 105*a*, 105*b* positioned substantially at the second end of the apparatus with its central longitudinal axis aligned with the Y axis of the apparatus, each platform and handle system supported by a stanchion 112*a*, 112*b* affixed to the support structure. A gripping handle 114*a*, 114*b* with a central axis substantially aligned with the Z axis is affixed to the stanchion.

Further, a left and right platform and handle system is substantially positioned at the first end of the apparatus, each handle system supported by a stanchion 113*a*, 113*b* comprising an upper horizontal platform and handle 106*a*, 106*b*, an upper gripping handle 107*a*, 107*b* with its central axis substantially aligned at an acute angle relative to the Z axis, a lower horizontal platform and handle 108*a*, 108*b* aligned with the Y axis, a lower handle 109*a*, 109*b* extending horizontally and laterally therefrom substantially aligned at an acute angle relative to the X axis, a leg press platform 110*a*, 110*b*, and a lower gripping handle 111*a*, 111*b* aligned at an acute angle to the Z axis.

A first plane of the exercise apparatus indicated by the dotted horizontal line labeled P1 is shown comprising the top exercise surfaces of the slidable platform 103, a first stationary platform 102, and a second stationary platform 101. In most all instances, exercisers will engage with at least one of the platforms on the first exercise plane just described. For ease of mounting the machine, the first plane P1 is positioned between 16.5 and 20 inches vertically above the plane of the floor P0, but preferably 18 inches above the plane P0 (e.g. the floor surface).

As can be readily seen, at least one additional secondary horizontal exercise plane is shown, specifically a second plane indicated by the dotted horizontal line labeled P2 extending across a pair of left and right platform and handle systems 105*a*, 105*b* positioned proximate to a second end platform 101, and a pair of lower platform handles 108*a*, 108*b*, 109*a*, 109*b* positioned proximate to a first end platform 102. The central axes of the platform handles 105*a*, 105*b*, 108*a*, 108*b*, 109*a*, 109*b* just described are substantially aligned with the Y axis of the apparatus, and may be used by an exerciser to support the downward force exerted upon any of these platforms by the exerciser, for example the exerciser's hands, arms, legs or feet. Further, an exerciser may use the platform handles for stability during exercise by grasping the conformable handles by placing their hands palm-down, their thumbs on the medial side of the platform handles and fingers on the lateral side of the platform handles, and squeezing the conformable platforms to use a gripping handles.

Through experimentation and practice, it was discovered that the vertical distance between the first plane P1 and the second plane P2 should range between 15 and 17 inches, but preferably the second plane P2 is positioned approximately 16 inches vertically above the first plane P1.

Yet a another second secondary horizontal exercise plane is shown, specifically an exercise plane indicated by the dotted horizontal line labeled P3 extending across a pair of left and right upper platform handles 106*a*, 106*b* the plane traversing substantially the width of the apparatus normal to the longitudinal axis. As previously described, the platforms may be used to support the downward pressure of the exerciser's hands, arms, legs, feet or other engaging part of the body, or may be used as conformable gripping handles whereby the handles may be grasped by the hands in at least two different positions, one position when the alignment of the finger knuckles are aligned substantially with the X axis of the apparatus, or when the finger knuckles are aligned substantially with the Y axis of the apparatus.

Through experimentation and practice, it was discovered that the vertical distance between the first plane P1 and the third plane P3 should range between 21 and 25 inches, but preferably the third plane P3 is positioned approximately 23 inches vertically above the first plane P1. Those skilled in the art will immediately appreciate that multiple exercise platforms that form multiple exercise planes represent a new and novel improvement of traditional Pilates apparatuses, and they will further appreciate that traditional Pilates apparatuses do not provide for stationary exercise platform handles aligned more closely to the vertical Z axis of an apparatus. Therefore, another new feature never before provided on horizontal resistance training apparatuses are a plurality of non-horizontal platform handles.

More specifically, fourth plane indicated by the dotted line labeled P4 is formed by platforms and handles 109*a*, 109*b*, 100, 111*a*, 111*b* affixed to a handle structure supported by stanchions 113*a*, 113*b* lateral to the central longitudinal axis of the apparatus, the central axes of the platform handles extending substantially vertically at an acute angle relative to the Z axis. It should be noted that the forward-leaning angle is aligned to closely approximate the most ergonomically beneficial position of the hands and wrists of an exercised positioned upon the slidable carriage 103 while grasping either of the pair of platform handles 111*a*, 111*b*.

A fifth plane P5 is formed by a pair of opposed platforms and handles 107*a*, 107*b* affixed to apparatus distal to the central longitudinal axis of the apparatus, the central axes of the platform handles extending substantially vertically at an acute angle relative to the Z axis, as will be more fully described in the following specification.

Figure 4:
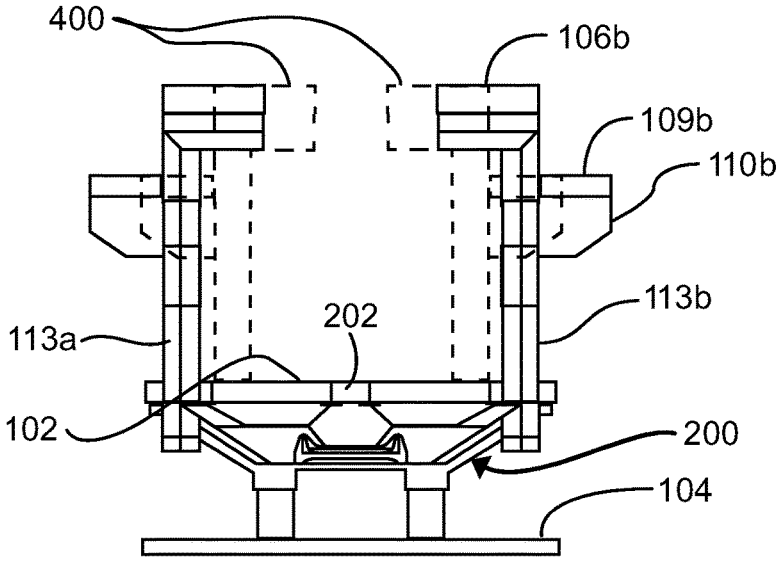
FIG. 4 is an exemplary diagram showing a front view of an exercise apparatus with an improved platform handle system.

FIG. 4 is an exemplary diagram showing a front view of an exercise apparatus with an improved platform handle system. Exercise platform 110*a*, 110*b* is wider than exercise platform handle 111*a*, 111*b*, extending laterally from the lateral edge of the lower platform handle and stanchion 113*a*, 113*b*. The additional width is useful and preferable when an exerciser places a foot upon the platform, the axis formed along the length of the foot being aligned substantially with the X axis of the apparatus.

An alternate position of the left and right handle assemblies is shown using a dotted line 400, the line illustrating that the distance between the handle assemblies may be decreased or increased by the exerciser to more closely align with the width of the exerciser's shoulders, thereby minimizing the potential for joint and soft tissue injury by exercisers otherwise using handles spread too wide, or positioned to narrowly.

Figure 5:
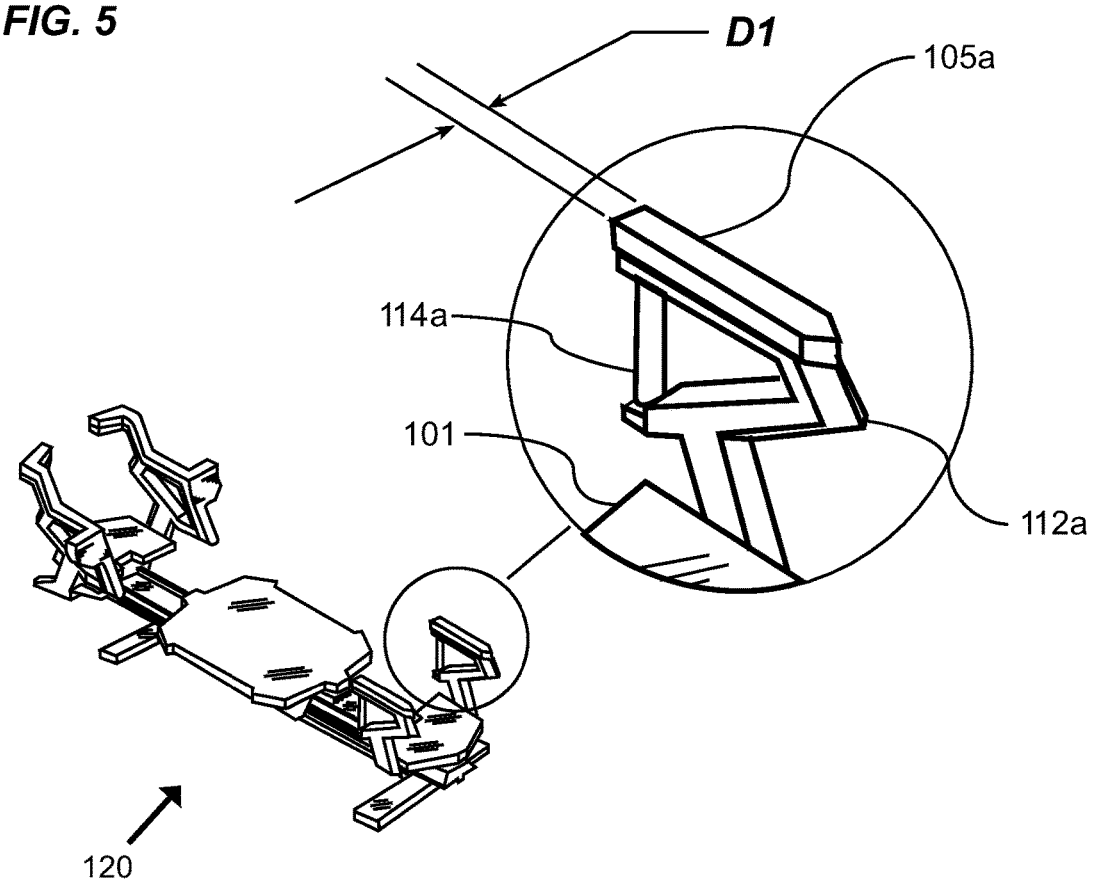
FIG. 5 is an exemplary diagram showing a detailed isometric view of a vertical handle and horizontal platform handle of an improved exercise apparatus.

FIG. 5 is an exemplary diagram showing a detailed isometric view of a vertical handle and horizontal platform handle assembly positioned substantially at a second distal end of an improved exercise apparatus. A pair of opposed platform handle assemblies are affixed to the structural base at a second end of the improved exercise apparatus 120. In an expanded view of one of the platform handle assemblies, a stanchion 112*a*, 112*b* is shown affixed to a stationary platform 101 at a second end of the apparatus.

In the drawing, a platform handle 105*a*, 105*b* is shown affixed to the top substantially horizontal portion of the stanchion, and a vertical gripping handle 114*a*, 114*b* is shown with each end affixed to upper and lower mounting positions on the stanchion. As can readily be seen, the vertical gripping handle 114*a*, 114*b* is representative of traditional round grab bars used for gripping handles on exercise equipment, on the other hand, the width dimension D1 of the top platform handle 105*a*, 105*b* is substantially larger than the diameter of the traditional gripping handle.

The larger width dimension of a conformable exercise platform provides previously unavailable support for the lower arms or hands of an exerciser, the width thereby distributing the downward force exerted by an exerciser over a substantially larger area than would otherwise be provided by a traditional round grab bar.

It should be noted that the width D1 is of such a dimension as to also allow the platform to be used as a handle. More specifically, the secure gripping circumference of the conformable platform approximates the length of an average exerciser's hand, from the heel of the palm to the tips of the fingers, uniquely providing for the platforms to be used equally well as gripping handles.

Although not shown, all other conformable platform handles as previously described herein similarly provide for circumferential measurements that approximate the length of an average exerciser's hand, allowing the interchangeable use of platforms as secure gripping handles.

Figure 6:
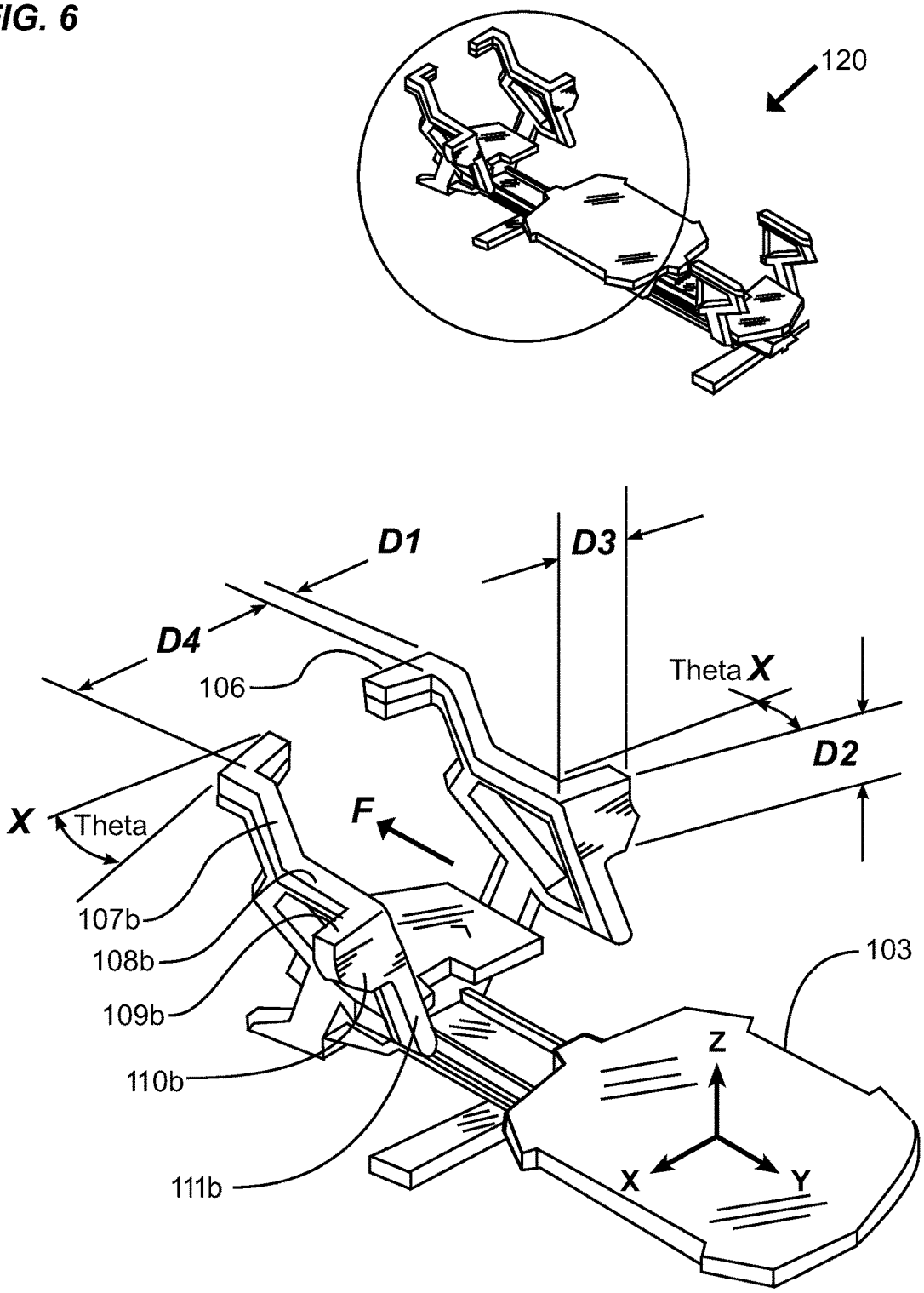
FIG. 6 is an exemplary diagram showing a detailed isometric view of the platform handle assemblies of the first end of an improved exercise apparatus.

FIG. 6 is an exemplary diagram showing a detailed isometric view of the platform handle assemblies of the first end of an improved exercise apparatus. An enlarged view of a first end of an improved apparatus 120 is provided for clarity, and shows a pair of platform handle assemblies, and specifically highlighting a left and right side upper horizontal platform and handle 106*a*, 106*b*, an upper gripping handle 107*a*, 107*b* aligned at an acute angle to the Z axis, a lower horizontal platform and handle 108*a*, 108*b* aligned with the Y axis, a lower handle 109*a*, 109*b* extending laterally therefrom aligned Theta degrees off of the X axis, a leg press platform 110*a*, 110*b* aligned Theta degrees off of the X axis, and a lower gripping handle 111*a*, 111*b* aligned at an acute angle to the Z axis.

It should be noted that as previously described, the upper horizontal platform and handle 106*a*, 106*b* and a leg press platform 110*a*, 110*b* are aligned substantially aligned with the X axis of the apparatus, the alignment previously described being equal to zero Theta degrees from the X axis. As shown in this figure, the opposed facing ends of the upper horizontal platform and handle 106*a*, 106*b* may be aligned with the X axis, or angled in a direction opposed to the slidable carriage 103, while the leg press platforms 110*a*, 110*b* may be aligned with the X axis, or angled in a direction towards the slidable carriage 103.

Therefore, the angle of Theta is preferably between zero degrees and 12 degrees acute angle relative to the X axis. Further, as can be readily seen, the dimensions D2, D3 of the leg press platforms 110*a*, 110*b* differ substantially from the width dimension D1 of the plurality of secondary platforms as previously described. As will be later described, the increased dimensions of the leg press platform 109*a*, 109*b* provide for substantially increased surface area to support the exerciser's feet whether the central axis of the feet are substantially aligned with either the Z axis or X axis of the apparatus, a new, novel and distinctive improvement never before available on traditional Pilates apparatuses.

As previously described FIG. 6, it is preferable that the distance D4 between the right and left handle assemblies be variable as preferred by approximating the width of the shoulders of an exerciser. The distance D4 between the right and left handle assemblies is preferably between 20-25 inches, with the distance D4 preferably being approximately 25 inches.

Figure 7:
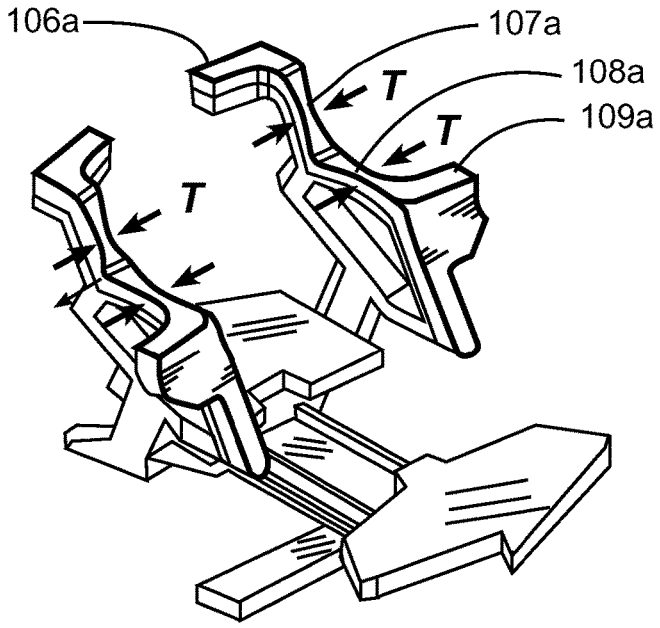
FIG. 7 is an exemplary diagram showing a detailed isometric view of an alternate configuration of platform handle assemblies of the first end of an improved exercise apparatus.

FIG. 7 is an exemplary diagram showing a detailed isometric view of an alternate configuration of platform handle assemblies of the first end of an improved exercise apparatus. In one version of the platform handles as previously described, the width dimension of the platform handles are sufficiently large so that they are supportive of weight bearing portions of the body that are rested upon the substantially wide platforms, yet the width remains such that an average hand will securely wrap substantially around the circumference of the conformable handle, thereby also serving as easily grasped handles.

In another variation and alternative embodiment of the present invention, FIG. 7 illustrates a contouring of the platforms as a means of increasing the ratio of the width of the supporting platform portions of the platform handles to the relatively decreased width of the grasping portions of the platform handles. More specifically, it can be readily seen that the width D1 of the upper horizontal platform and handle 106*a*, 106*b*, is reduced by tapering T the longitudinal edges of the upper gripping handle 107*a*, 107*b* inwardly towards the central axis of the handle, thereby providing for a smaller circumferential dimension in the section that will be used as a handle. Continuing towards the lower horizontal platform and handle 108*a*, 108*b*, can be readily appreciated that the width of the platform at the point of transition between the upper gripping handle 107*a*, 107*b* and the lower horizontal platform and handle 108*a*, 108*b* tapers relatively outward, creating a wider portion of the platform.

Then once more, the gripping portion of the lower horizontal platform and handle 108*a*, 108*b* is reduced by tapering T the longitudinal edges of the lower horizontal platform and handle 108*a*, 108*b* inwardly towards the central axis of the handle, thereby providing for a smaller circumferential dimension in the section that will be used as a handle. Finally, as the lower narrowed portion of the horizontal platform and handle 108*a*, 108*b* approaches the point of transition to the leg press platform 109*a*, 109*b*, the width once again tapers away from the central axis of the handle, creating a wider platform.

How, in use, those skilled in the art will immediately recognize that an exerciser placing a forearm on the lower horizontal platform and handle 108*a*, 108*b* will rest the elbow on the wider transition point between the lower horizontal platform and handle 108*a*, 108*b* and the leg press platform 109*a*, 109*b*, and further grasp the upper gripping handle 107*a*, 107*b* at the comfortable, inwardly tapered portion.

It should be noted that the just described inward or outward tapering of the platform handles, and the location of the tapers is not meant to be limiting. Those skilled in the art will recognize that only tapering inwardly from an otherwise fixed-width platform, or only tapering outwardly from a fixed width platform, or changing the positions of the wider or narrower portions of the platform handles may be preferred in order to accomplish various and different exercises, yet the relatively wide and narrow portions nevertheless continuing to define the primary weight supporting points and gripping points respectively.

Figure 8A:
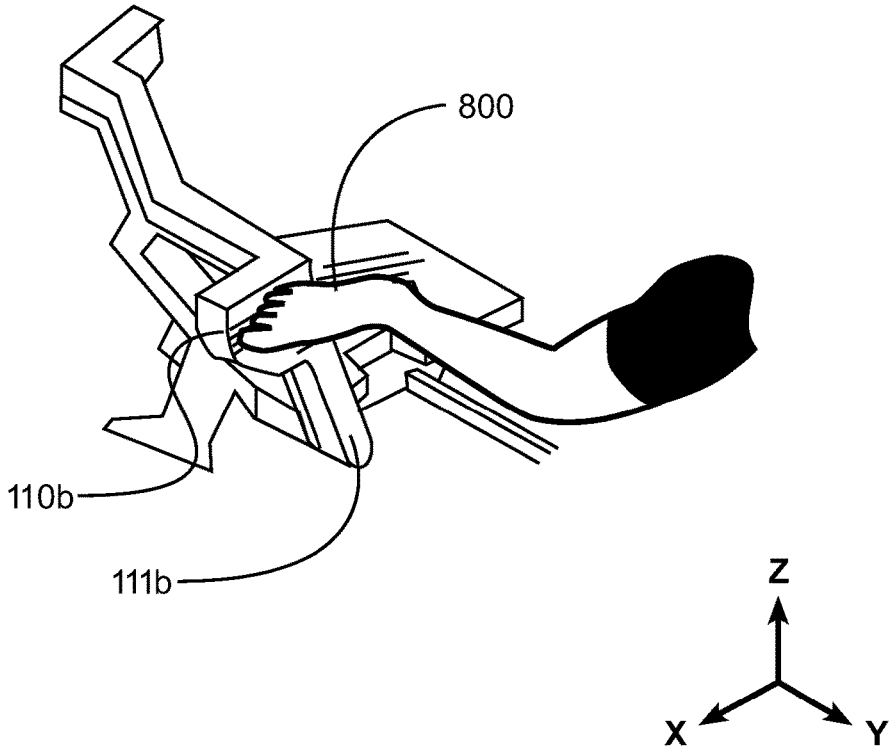
FIG. 8A is an exemplary diagram showing the side view of an exerciser placing their foot horizontally oriented upon a platform handle.

FIG. 8A is an exemplary diagram showing the side view of an exerciser on an improved fitness apparatus placing their foot horizontally oriented upon a platform handle. In a close-up view, it can be seen that the length of the foot 800 is substantially aligned with the X axis. The foot, having been placed on the leg press platform 110*a*, 110*b* is substantially supported along both its length and width, thereby providing foot and angle stability not provided on traditional exercise apparatuses with a spring biased slidable carriage.

Figure 8B:
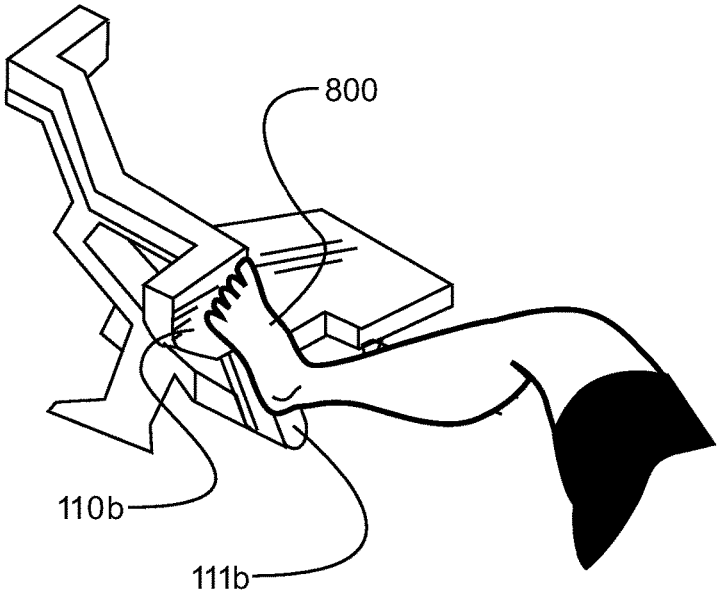
FIG. 8B is an exemplary diagram showing the side view of an exerciser placing their foot vertically oriented upon a platform handle.

FIG. 8B is an exemplary diagram showing the side view of an exerciser placing their foot 800 horizontally oriented upon a traditional Pilates cross bar. As can be readily understood, traditional apparatuses equipped with a tubular cross bar not only fail to support the entirety of the width of the foot, the relatively narrow surface area of a cross bar frustrates the exerciser's ability to quickly and confidently place a foot on the cross bar, and further, once the foot is placed, the narrow surface area increases pressure along the contact portions of the foot, causing pain, and inhibiting the exerciser from aggressively performing the exercise.

The results typically encountered, and which are solved by the present invention, are that the foot can occasionally slip off of the round bar, the ankle sustains injury due to the lack of foot and ankle stability, and the increased pain causes the exerciser to use less pressure, and therefore realize fewer fitness benefits when compared to using higher pressure against higher resistance forces when the food is not experiencing pain.

Figure 9A:
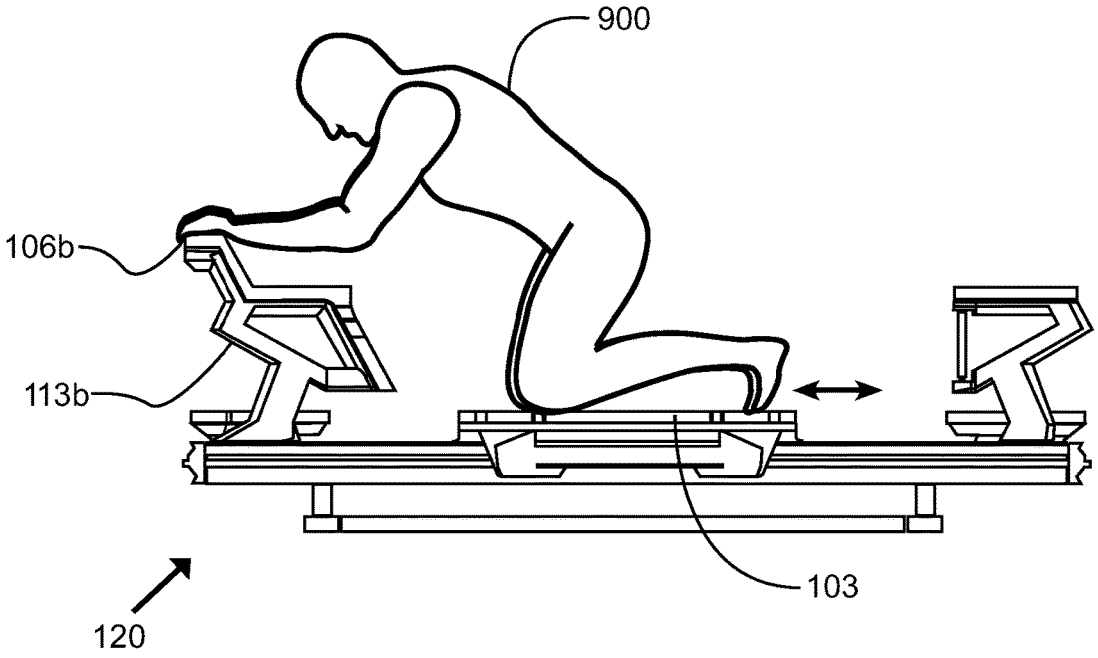
FIG. 9A is an exemplary diagram showing the side view of an exerciser upon an improved exercise apparatus with hands gripping a first set of platform handles in accordance with an example embodiment.

FIG. 9A is an exemplary diagram showing the side view of an exerciser 900 upon an improved exercise apparatus 120 with the hands gripping the upper horizontal platform and handles 106*a*, 106*b* with palms facing down, the handles being supported by a pair of substantially vertical stanchions 113*a*, 113*b*, the stanchions and platform handle assemblies on the right and left sides of the apparatus being substantially mirror images of each other.

The exerciser is mounted on the slidable carriage 103 in a kneeling position facing a first end of the apparatus, and is shown moving the carriage toward and away from the first end to which one or more biasing members (e.g. springs, elastic bands, etc.) are attached which provide a biasing force to the carriage.

Figure 9B:
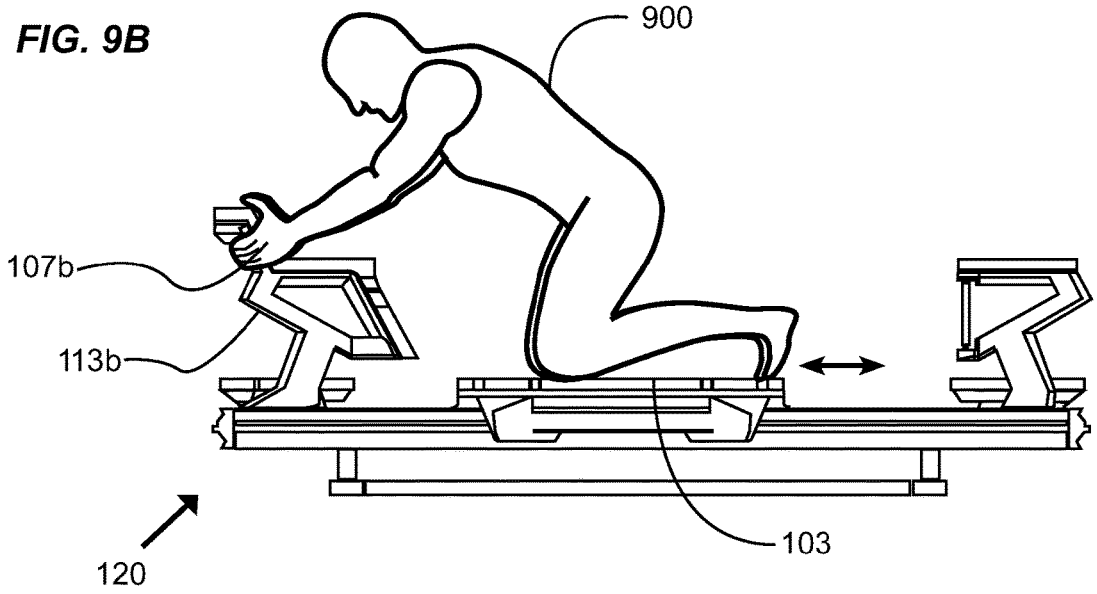
FIG. 9B is an exemplary diagram showing the side view of an exerciser upon an improved exercise apparatus with hands gripping a second set of platform handles in accordance with an example embodiment.

The relatively high position of the hands on the platform handle assembly intensifies the muscle stimulation, and therefore the exercise training of the higher muscles of the shoulders and back. FIG. 9B is an exemplary diagram showing the side view of an exerciser 900 upon an improved exercise apparatus 120 with the hands gripping the upper gripping handles 107*a*, 107*b* with palms facing each other, the handles being supported by a pair of substantially vertical stanchions 113*a*, 113*b*, the stanchions and platform handle assemblies on the right and left sides of the apparatus being substantially mirror images of each other.

The exerciser is mounted on the slidable carriage 103 in a kneeling position facing a first end of the apparatus, and is shown moving the carriage toward and away from the first end to which a biasing member is attached. The relatively high palms-inward position of the hands on the platform handle assembly intensifies the muscle stimulation, and therefore the exercise training of the upper shoulders, back and upper chest.

Figure 9C:
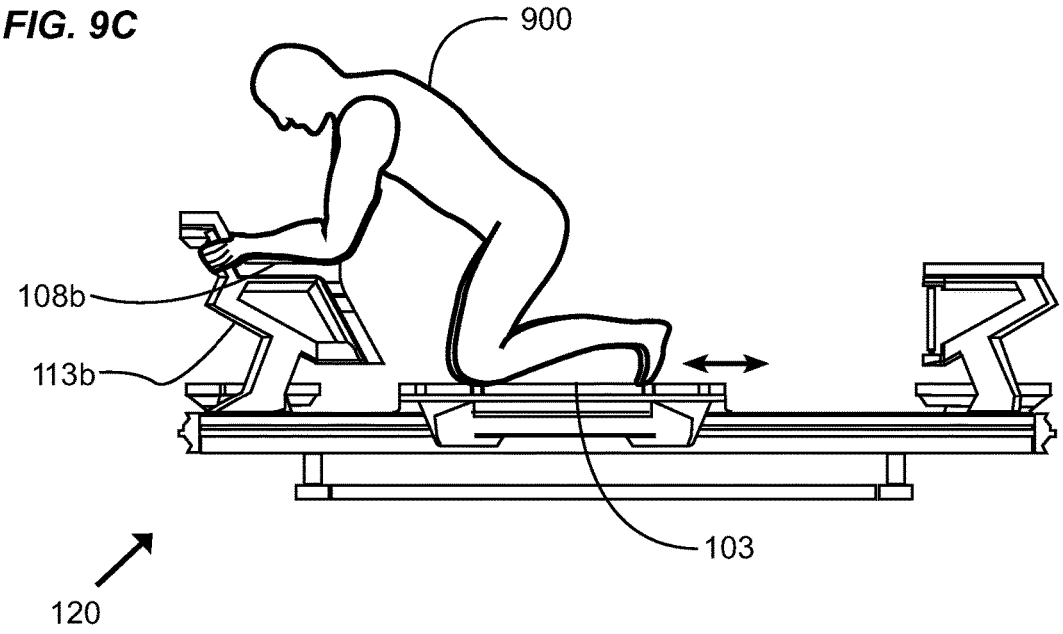
FIG. 9C is an exemplary diagram showing the side view of an exerciser upon an improved exercise apparatus with hands gripping a third set of platform handles in accordance with an example embodiment.

FIG. 9C is an exemplary embodiment showing the side view of an exerciser 900 upon an improved exercise apparatus 120 with the forearms resting on the lower horizontal platforms 108*a*, 108*b*, the platforms being supported by a pair of substantially vertical stanchions 113*a*, 113*b*, the stanchions and platform handle assemblies on the right and left sides of the apparatus being substantially mirror images of each other. The exerciser is mounted on the slidable carriage 103 in a kneeling position facing a first end of the apparatus, and is shown moving the carriage toward and away from the first end to which a biasing member is attached. The position whereby the forearms are rested upon the platform isolates the lower arm muscles, and increases the muscle stimulation, and therefore the exercise training of shoulders, chest, core abdomen and upper leg muscles.

Figure 9D:
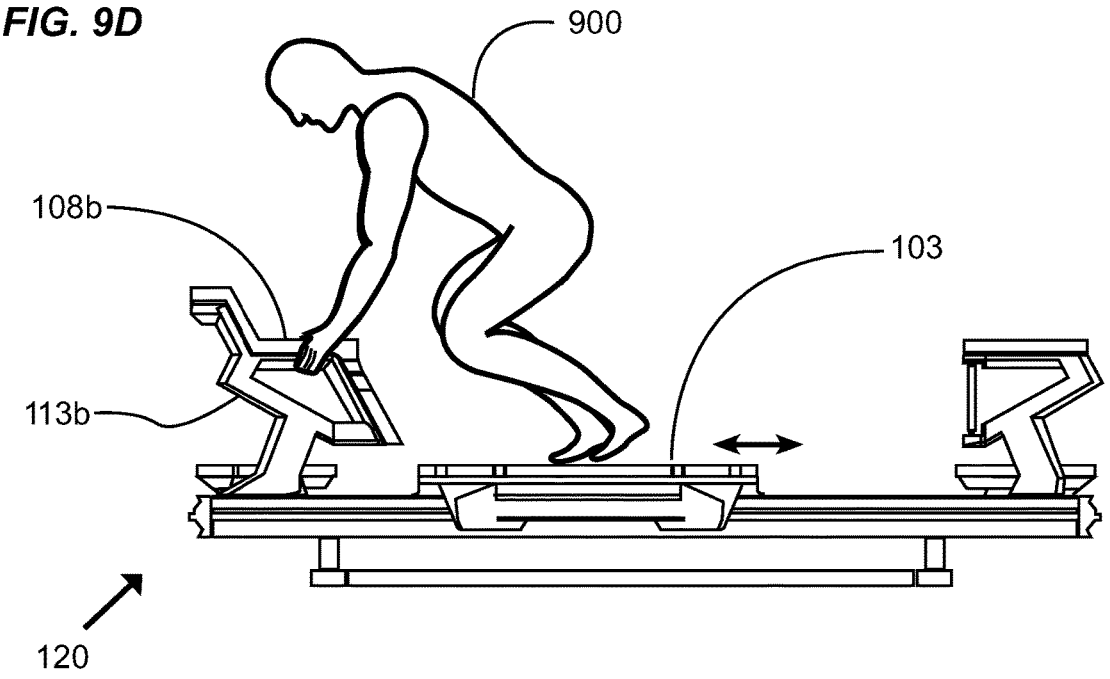
FIG. 9D is an exemplary diagram showing the side view of an exerciser upon an improved exercise apparatus with hands gripping a fourth set of platform handles in accordance with an example embodiment.

FIG. 9D is an exemplary embodiment showing the side view of an exerciser 900 upon an improved exercise apparatus 120 with the hands gripping the lower horizontal platform and handles 108*a*, 108*b*, the handles being supported by a pair of substantially vertical stanchions 113*a*, 113*b*, the stanchions and platform handle assemblies on the right and left sides of the apparatus being substantially mirror images of each other. The exerciser is mounted on the slidable carriage 103 in a standing position facing a first end of the apparatus, and is shown moving the carriage toward and away from the first end to which a biasing member is attached. The unstable couched position created by the position of the hands on the platform handle assembly and standing position on the slidable carriage intensifies the muscle stimulation, and therefore the exercise training of arms, legs and core muscle groups.

Figure 9E:
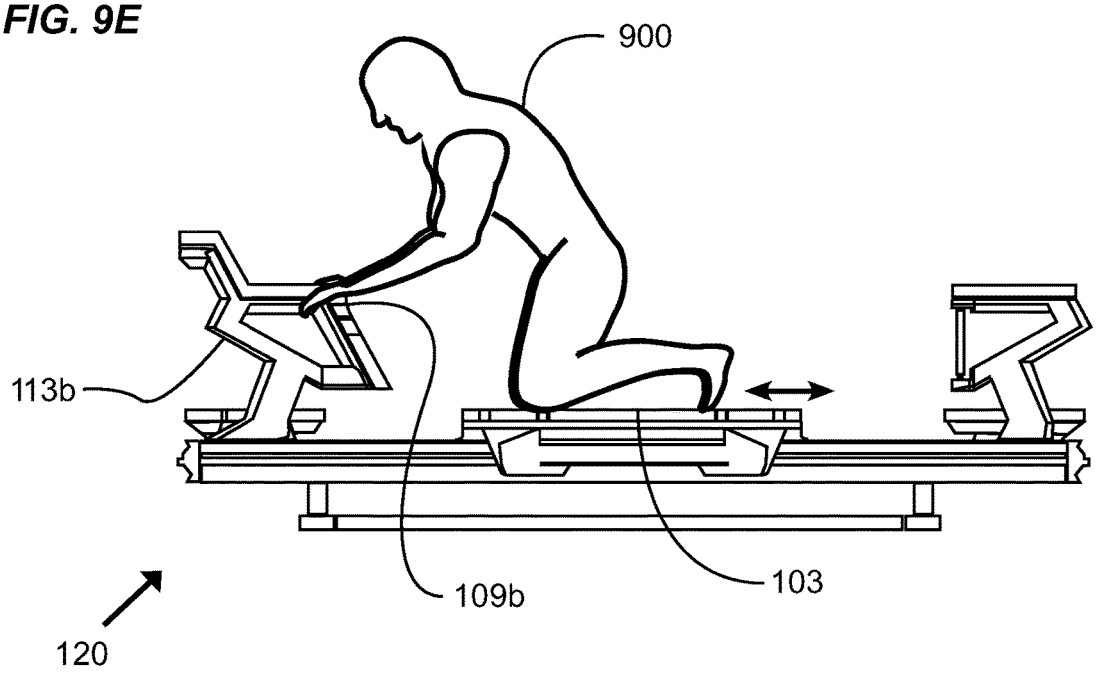
FIG. 9E is an exemplary diagram showing the side view of an exerciser upon an improved exercise apparatus with hands gripping a fifth set of platform handles in accordance with an example embodiment.

FIG. 9E is an exemplary diagram showing the side view of an exerciser 900 upon an improved exercise apparatus 120 with the hands gripping the lower handles 109*a*, 109*b* with palms facing downward, the handles being supported by a pair of substantially vertical stanchions 113*a*, 113*b*, the stanchions and platform handle assemblies on the right and left sides of the apparatus being substantially mirror images of each other. The exerciser is mounted on the slidable carriage 103 in a kneeling position facing a first end of the apparatus, and is shown moving the carriage toward and away from the first end to which a biasing member is attached. The relatively low position of the hands on the platform handle assembly intensifies the muscle stimulation, and therefore the exercise training of the chest and abdomen.

Figure 9F:
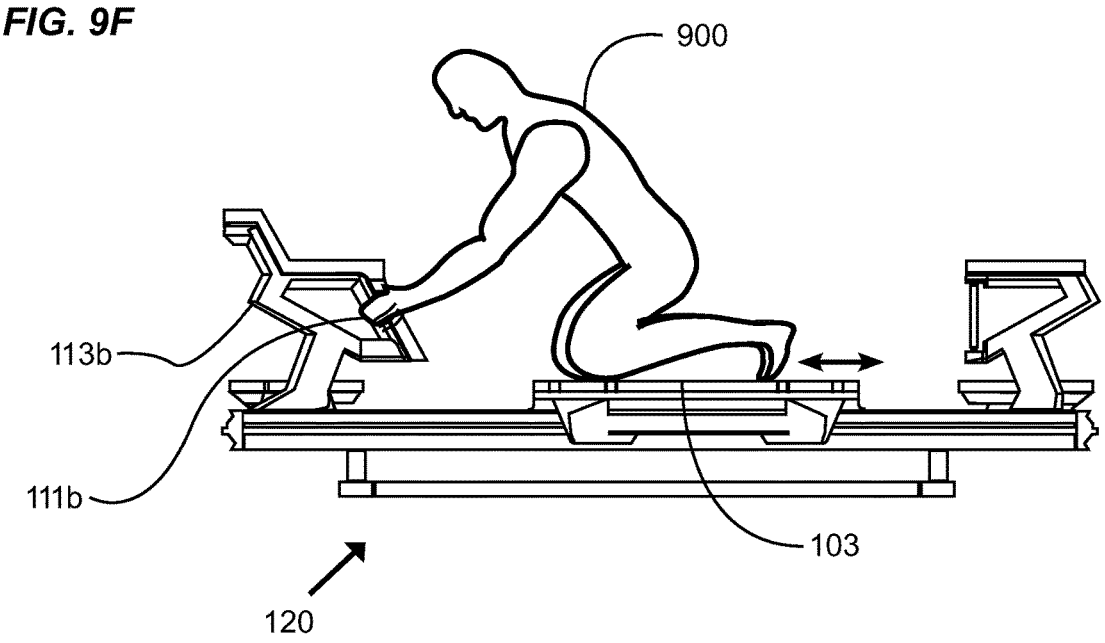
FIG. 9F is an exemplary diagram showing the side view of an exerciser upon an improved exercise apparatus with hands gripping a sixth set of platform handles in accordance with an example embodiment.

FIG. 9F is an exemplary diagram showing the side view of an exerciser 900 upon an improved exercise apparatus 120 with the hands gripping the lower gripping handles 111*a*, 111*b*, the handles being supported by a pair of substantially vertical stanchions 113*a*, 113*b*, the stanchions and platform handle assemblies on the right and left sides of the apparatus being substantially mirror images of each other. The exerciser is mounted on the slidable carriage 103 in a kneeling position facing a first end of the apparatus, and is shown moving the carriage toward and away from the first end to which a biasing member is attached. The low position of the hands on the platform handle assembly intensifies the muscle stimulation, and therefore the exercise training of chest, abdomen and upper leg muscles.

Figure 9G:
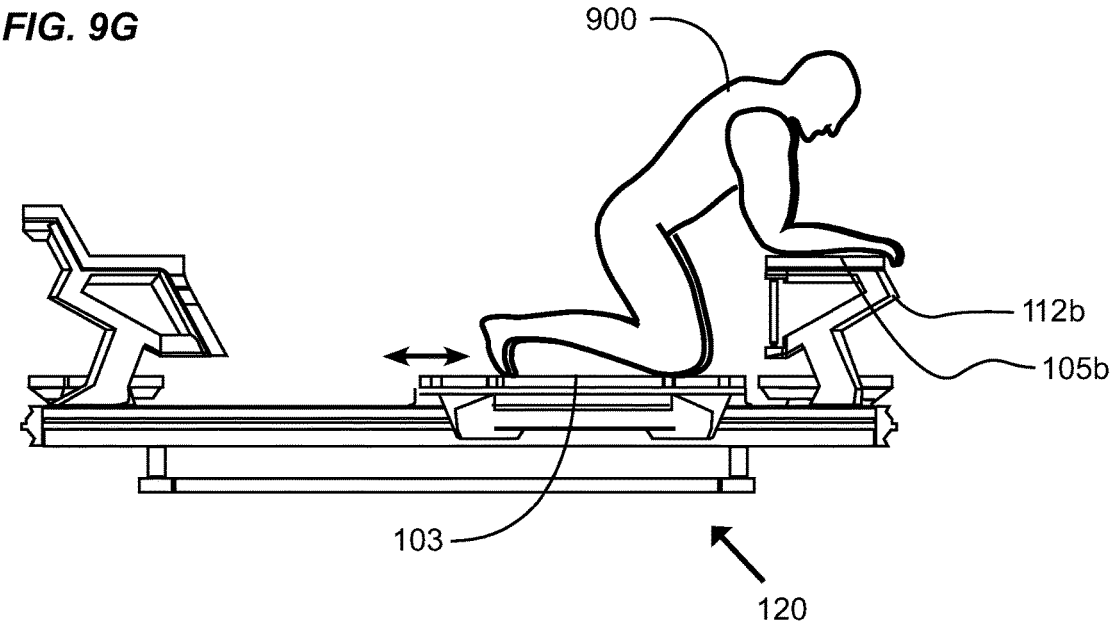
FIG. 9G is an exemplary diagram showing the side view of an exerciser upon an improved exercise apparatus with hands gripping a seventh set of platform handles in accordance with an example embodiment.

FIG. 9G is an exemplary diagram showing the side view of an exerciser 900 upon an improved exercise apparatus 120 with the hands gripping the distal ends of platform and handles 105*a*, 105*b*, the handles being supported by a pair of substantially vertical stanchions 112*a*, 112*b*, the stanchions and platform handle assemblies on the right and left sides of the apparatus being substantially mirror images of each other. The exerciser is mounted on the slidable carriage 103 in a kneeling position facing a second end of the apparatus, and is shown moving the carriage toward and away from the first end to which a biasing member is attached. The low, stabilized lower arm position on the platform handle assembly intensifies the muscle stimulation, and therefore the exercise training of the front of the shoulders, triceps, lower back and upper back of the legs.

Figure 9H:
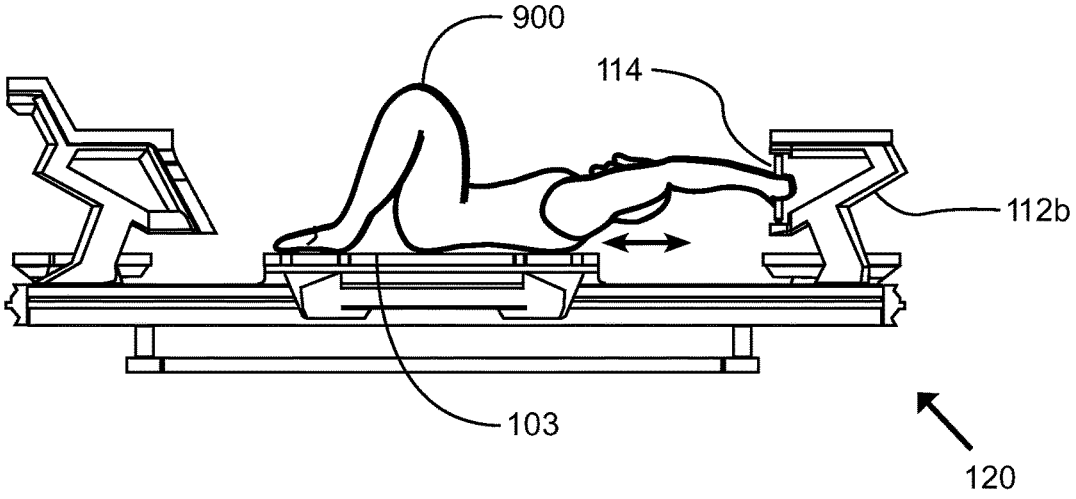
FIG. 9H is an exemplary diagram showing the side view of an exerciser upon an improved exercise apparatus with hands gripping an eighth set of platform handles in accordance with an example embodiment.

FIG. 9H is an exemplary diagram showing the side view of an exerciser 900 upon an improved exercise apparatus 120 with the hands gripping a gripping handles 114*a*, 114*b*, the handles being supported by a pair of substantially vertical stanchions 112*a*, 112*b*, the stanchions and platform handle assemblies on the right and left sides of the apparatus being substantially mirror images of each other. The exerciser is mounted on the slidable carriage 103 in a supine position with the head facing a second end of the apparatus, and is shown moving the carriage toward and away from the first end to which a biasing member is attached. The overhead position of the hands on the gripping handles intensifies the muscle stimulation, and therefore the exercise training of the triceps, chest, shoulders and back.

Figure 9I:
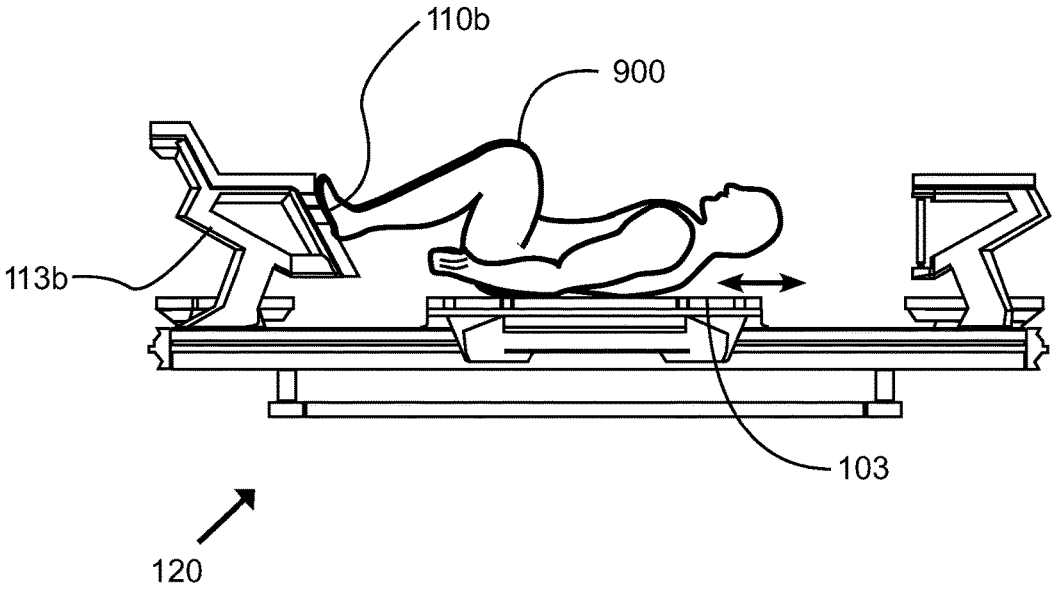
FIG. 9I is an exemplary diagram showing the side view of an exerciser upon an improved exercise apparatus with feet placed upon a first set of pushing platforms in accordance with an example embodiment.

FIG. 9I is an exemplary diagram showing the side view of an exerciser 900 upon an improved exercise apparatus 120 with the feet pushing against a pair of leg press platforms 110*a*, 110*b*, the platforms being supported by a pair of substantially vertical stanchions 113*a*, 113*b*, the stanchions and platform handle assemblies on the right and left sides of the apparatus being substantially mirror images of each other. The exerciser is mounted on the slidable carriage 103 in a supine position with the head facing a second end of the apparatus, and is shown moving the carriage toward and away from the first end to which a biasing member is attached. The supine squat position of the legs on the leg press platforms intensifies the muscle stimulation, and therefore the exercise training of the leg muscles and lower back.

It should be noted that the lengthy description of the many exercises just illustrated are not exhaustive, and the illustrated exerciser interfaces with the many platforms and handles are not meant to me limiting. Those skilled in the art will immediately appreciate that a great number of different exercises that cannot be practiced on traditional exercise machines can, for the first time, be performed on the improved apparatus of the present invention.

Figure 10A:
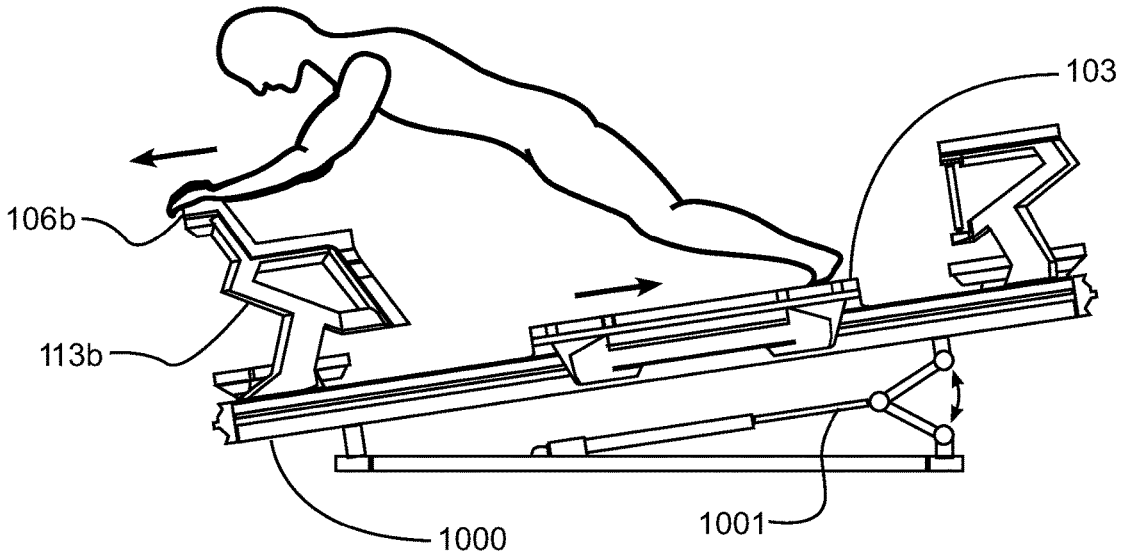
FIG. 10A is an exemplary diagram showing the side view of an exerciser performing an exercise on a tilted apparatus rotated about the pitch axis to raise or lower one or both ends of the exercise machine in accordance with an example embodiment.

FIG. 10A is an exemplary diagram and embodiment showing the side view of an exerciser performing an exercise on a tilted apparatus. An alternate base structure 1000 is shown hingably attached to the supporting feet at a first end, and a tilt actuation device positioned such that actuation causes the second end of the structure to elevate at a preferred acute angle relative to the horizontal plane.

The exercise, often referred to as the "flying push up" is performed by placing the hands on the handles 106*a*, 106*b* at a first end of the apparatus, and placing the feet on the slidable carriage 103 when the carriage is positioned substantially proximal to the first end of the structure. The slidable carriage 103 is resistance biased toward the first end by means of springs or elastic cords. To begin the exercise, the exerciser uses arms, core muscles and legs to push the carriage towards the second end in the direction shown, the force of the push being the sufficient to overcome the sum of the resistance bias and the contributed portion of the exerciser's body weight that is being pushed up the incline. Now then, the hands in this instance are pressing against the conformable platform, being positioned upon the contact surfaces 106*a*, 106*b* being used as platforms. It can be readily appreciated that the hands are not grasping these support surfaces as handles which, in various other exercises would be used as a means for the exerciser to pull against, rather than push.

U.S. Patent Publication No. US-2015-0057127-A1 to Lagree illustrates an exemplary exercise apparatus suitable for use as the tilting base structure about a pitch axis for the present invention and is hereby incorporated by reference in its entirety herein. The pitch axis may be the middle portion, the first end or the second end of the frame. The frame of the present invention may also be pivoted to either the left side or the right side about the longitudinal axis (the roll axis).

Figure 10B:
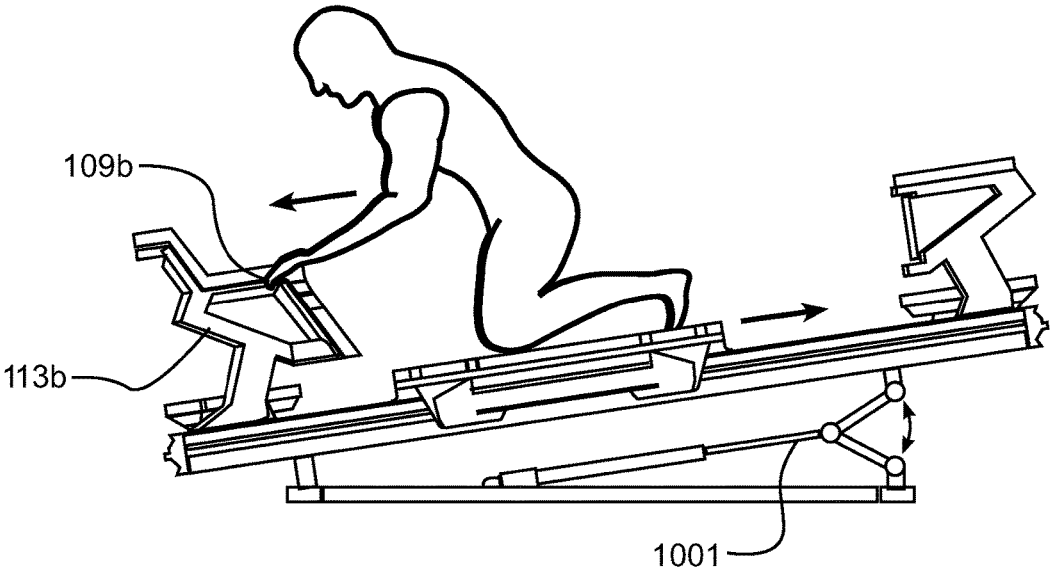
FIG. 10B is an exemplary diagram showing the side view of an exerciser performing an alternate exercise up a tilted apparatus rotated about the pitch axis, in accordance with an example embodiment.

FIG. 10B is an exemplary diagram showing the side view of an exerciser performing an alternate exercise up a tilted apparatus. As another variation of the exercise just described, another exercise, often referred to as the "ice breaker" is performed by placing the hands on the handles 109*a*, 109*b* at a first end of the apparatus, and placing the knees and feet on the slidable carriage 103 when the carriage is positioned substantially proximal to the first end of the structure. The slidable carriage 103 is resistance biased toward the first end by means of springs or elastic cords. To begin the exercise, the exerciser uses arms, core muscles and legs to push the carriage towards the second end in the direction shown, the force of the push being the sufficient to overcome the sum of the resistance bias and the contributed portion of the exerciser's body weight that is being pushed up the incline. As can be readily appreciated by those skilled in the art, in the foregoing exercises just described, the multiple contact surfaces of the exercise machine are being used as platforms against which to push in order to complete the intended exercises.

Figure 11:
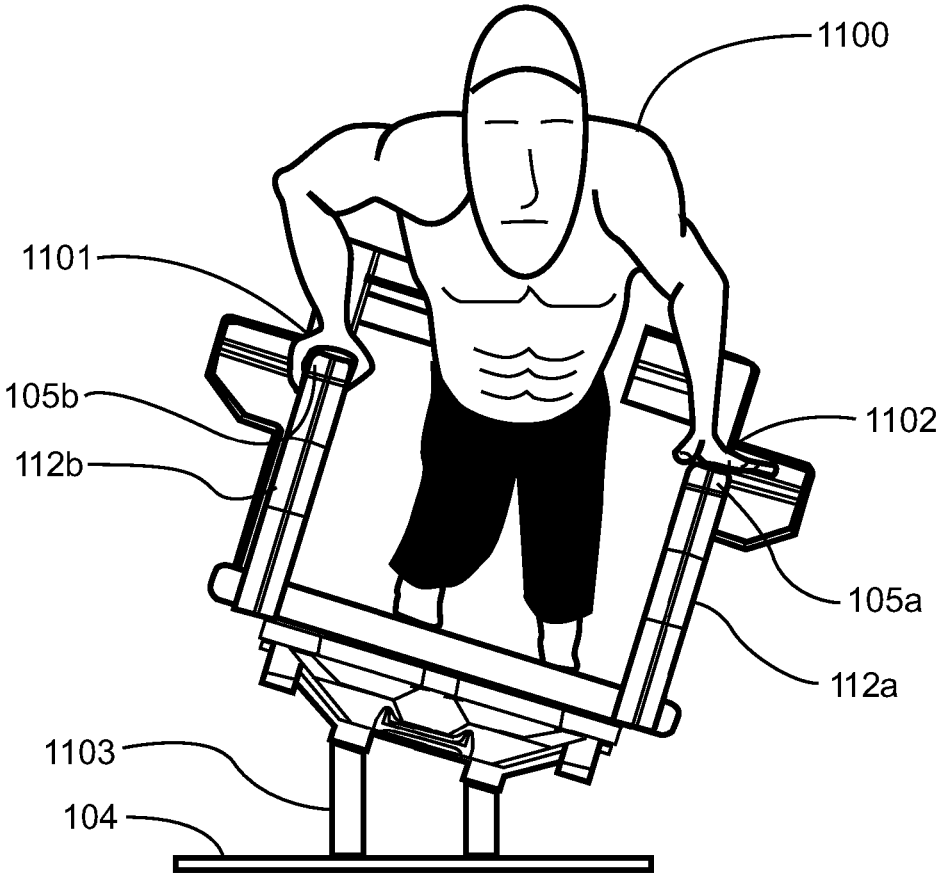
FIG. 11 is an exemplary diagram showing a front view of an exerciser performing an exercise on an apparatus rotated about the longitudinal axis (roll axis) to one side.

FIG. 11 is an exemplary diagram showing a front view of an exerciser 1100 performing an exercise on an apparatus rotated about the longitudinal axis. An alternate base structure 1103 is shown hingably attached to the supporting feet 104, and a rotation actuation device 1103 is positioned such that actuation causes the structure to rotate about the longitudinal axis of the machine. The exerciser has placed a left hand 1102 upon the contact surface 105*a*, 105*b* with a substantially opened palm, the hand pressing upon the contact surface as a means of supporting the weight induced on the left arm by the downward left hand tilt of the machine. The right hand 1101 of the exerciser is shown grasping the right hand contact surface 105*a*, 105*b* as a means of pulling the centerline of the body proximate to the longitudinal center of the machine.

The contact surfaces 105*a*, 105*b* are supported by stanchions 112*a*, 112*b*, the left and right stanchions and contact surfaces being mirrors of one another. Now then, those skilled in the art will appreciate that in order for an exerciser to perform the exercise from the position shown, one contact surface of the present invention will be pushed against as support, while the other identical but mirrored contact surface will be used as a grasping handle, pulled against by the exerciser.

An exemplary embodiment of the present invention is an exercise machine with multiple contact surfaces for the exerciser to make physical contact with during the performance of an exercise with their various body parts (e.g. hands, elbows, wrists, arms, feet, shins, knees, legs and otherwise). A frame 200 of the exercise machine includes a first end 202, a second end 204 and a longitudinal axis. The frame 200 includes at least one rail 100. A carriage 103 is movably connected to the rail 100, wherein the carriage 103 is movable between the first end and the second end of the rail 100. The carriage 103 also has an upper surface aligned with a first plane P1. The exemplary embodiment of the exercise machine further preferably includes a first support structure 300*a* and a second support structure 300*b* attached to the frame 200 near the first end 202 or second end 204 of the exercise machine. The first support structure 300*a* and the second support structure 300*b* are preferably positioned on opposing sides of the longitudinal axis. The first support structure 300*a* and the second support structure 300*b* each further preferably include a first platform 108*a*, 108*b* having an upper surface that is aligned with a first plane P2 that is positioned above the first plane of the carriage.

The first support structure 300*a* and the second support structure 300*b* each preferably include a first handle 111*a*, 111*b*. The first handle 111*a*, 111*b* is preferably positioned below the upper surface of the first platform 108*a*, 108*b*. The first handle 111*a*, 111*b* is substantially vertically orientated. The first handle 111*a*, 111*b* may have a cylindrical shape or an inner face that is substantially flat. The inner face of the first handle 111*a*, 111*b* is preferably angled with respect to the upper surface of the first platform 108*a*, 108*b*.

The upper surface of the first platform 108*a*, 108*b* is preferably elongated, straight and/or narrow in at least one embodiment of the present invention. The upper surface of the first platform 108*a*, 108*b* is preferably stationary but may be movable. The upper surface of the first platform 108*a*, 108*b* is substantially straight. The upper surface of the first platform 108*a*, 108*b* preferably includes a first portion (the portion the lead lines for 108*a* and 108*b* point to) that is substantially parallel with respect to the longitudinal axis of the exercise machine 120. The upper surface of the first platform 108*a*, 108*b* further preferably includes a second portion 109*a*, 109*b* that is aligned substantially transversely with the first portion. The second portion 109*a*, 109*b* of the upper surface of the first platform extends outwardly away from the longitudinal axis forming an L-shaped surface with the first portion. The first portion and the second portion 109*a*, 109*b* of the upper surface of the first platform are preferably on the same plane.

The first support structure 300*a* and the second support structure 300*b* each preferably include a leg press platform 110*a*, 110*b* extending downwardly from the first platform 108*a*, 108*b*, wherein the leg press platform 110*a*, 110*b* has a substantially flat surface that is aligned on a plane that is at an angle with respect to the longitudinal axis of the frame 200. The first support structure 300*a* and the second support structure 300*b* each further preferably include a first handle 111*a*, 111*b* extending downwardly from the leg press platform 110*a*, 110*b*. The first support structure 300*a* and the second support structure 300*b* each include an upper handle 107*a*, 107*b* that extends upwardly from the upper surface of the first platform 108*a*, 108*b*. The upper handle 107*a*, 107*b* extends away from a center location of the frame 200 at an upward angle.

The first support structure 300*a* and the second support structure 300*b* further preferably each include a second platform 106*a*, 106*b* extending from the upper handle 107*a*, 107*b*, wherein the second platform 106*a*, 106*b* has an upper surface. The second platform 106*a*, 106*b* extends inwardly toward a central longitudinal axis of the frame 200. The second platform 106*a*, 106*b* extends along an axis that is substantially transverse with respect to the central longitudinal axis of the frame 200. The second platform 106*a*, 106*b* extends along an axis that is substantially transverse with respect to the first platform 108*a*, 108*b*. The upper surface of the second platform 106*a*, 106*b* is aligned with a third plane P3, wherein the third plane P3 is above the second plane P2 and the first plane P1. The first plane P1, the second plane P2 and the third plane P3 are substantially parallel with respect to one another. A first distance between the first plane P1 and the second plane P2 is substantially greater than a second distance between the second plane P2 and the third plane P3.

The first support structure 300*a* and the second support structure 300*b* preferably substantially mirror one another. The first support structure 300*a* and the second support structure 300*b* are distally spaced apart from one another and are preferably not connected directly to one another though they may be connected together. The first support structure 300*a* and the second support structure 300*b* may also be distally spaced apart from one another and are individually movable toward or apart from one another along an axis traverse to the longitudinal axis of the base structure.

The frame 200 may be movably connected to a base to allow for adjustment of the state of the exercise machine (e.g. to elevate, tilt and the like) or non-movably attached to the base. For example, the first end and/or the second end of the frame 200 may be adapted to be elevated and/or lowered by an actuator about a pitch axis. The frame 200 may also be adapted to be rotated about the longitudinal axis (or a roll axis) alone or in combination with the ability to elevate and/or lower.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments, inclinable apparatus, and instruction and apparatus control methods discussed herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine with multiple contact surfaces, suitable methods and materials are described above. All publications, patent applications, patents, and other references mentioned herein are incorporated by reference in their entirety to the extent allowed by applicable law and regulations. The exercise machine with multiple contact surfaces may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine with multiple contact surfaces, comprising:

a frame having a first end, a second end and a longitudinal axis, wherein the frame includes a rail;

a first stationary platform connected to the frame near the first end of the frame, wherein the first stationary platform is configured to support a body part of an exerciser;

a second stationary platform connected to the frame near the second end of the frame, wherein the second stationary platform is configured to support a body part of an exerciser;

a carriage movably connected to the rail, wherein the carriage is movable between the first end and the second end of the rail and wherein the carriage has an upper surface;

a biasing member connected to the carriage, wherein the biasing member is adapted to provide a biasing force to the carriage; and a first support structure and a second support structure attached to the frame near the first end, wherein the first support structure and the second support structure are positioned on opposing sides of the frame and extend upwardly from the frame, wherein the first support structure and the second support structure each include a plurality of surfaces at different angles relative to the longitudinal axis configured to simultaneously support multiple surfaces of the exerciser, wherein the first support structure and the second support structure are each configured to provide a plurality of locations to grasp by the exerciser and wherein the first support structure and the second support structure each include a first support platform having an upper surface configured to support the wrists of the exerciser, wherein the upper surface of the first support platform is positioned above the upper surface of the carriage;

wherein the upper surface of the first support platform is elongated and narrow, wherein the upper surface of the first support platform has a length and a width, wherein the length of the upper surface of the first support platform is greater than the width of the first support platform;

wherein the first stationary platform is positioned between the first support structure and the second structure;

wherein the upper surface of the first support platform is stationary;

wherein the first support structure and the second support structure each include a first handle, wherein the first handle is positioned below the upper surface of the first support platform and wherein the first handle is substantially vertically orientated;

wherein the first support structure and the second support structure each include an upper handle that extends upwardly from the first support platform.

2. The exercise machine of claim 1, wherein the first handle has a cylindrical shape.

3. The exercise machine of claim 1, wherein the first handle has an inner face, wherein the inner face is substantially flat.

4. The exercise machine of claim 3, wherein the inner face of the first handle is angled with respect to the upper surface of the first support platform.

5. The exercise machine of claim 1, wherein the upper surface of the first support platform is elongated.

6. The exercise machine of claim 1, wherein the upper surface of the first support platform is elongated and straight.

7. The exercise machine of claim 1, wherein the upper surface of the first support platform is narrow.

8. The exercise machine of claim 1, wherein the upper surface of the first support platform is substantially straight.

9. The exercise machine of claim 1, wherein the upper surface of the first support platform is flat.

10. The exercise machine of claim 1, wherein the upper surface of the first support platform is planar.

11. The exercise machine of claim 1, wherein the upper surface of the first support platform is elongated and planar.

12. The exercise machine of claim 1, wherein the upper surface of the first support platform is planar and flat.

13. The exercise machine of claim 1, wherein the upper surface of the first support platform is planar and narrow.

14. The exercise machine of claim 1, wherein the upper surface of the first support platform is planar, elongated and narrow.

15. The exercise machine of claim 1, wherein the upper surface of the first support platform includes a second portion that is aligned substantially transversely with the first portion.

16. The exercise machine of claim 15, wherein the second portion of the upper surface of the first support platform extends outwardly away from the longitudinal axis forming an L-shaped surface.

17. The exercise machine of claim 15, wherein the first portion and the second portion of the upper surface of the first support platform are on a common plane.

18. The exercise machine of claim 1, wherein the first support structure and the second support structure each include a leg press platform extending downwardly from the first support platform, wherein the leg press platform has a substantially flat surface that is aligned on a plane that is at an angle with respect to the longitudinal axis of the frame.

19. The exercise machine of claim 18, wherein the first handle extends downwardly from the leg press platform.

20. The exercise machine of claim 1, wherein the upper handle extends away from a center location of the frame at an upward angle.

21. The exercise machine of claim 1, wherein the first support structure and the second support structure each include a second platform extending from the upper handle, wherein the second platform has an upper surface.

22. The exercise machine of claim 21, wherein the second platform extends inwardly toward a central longitudinal axis of the frame.

23. The exercise machine of claim 21, wherein the upper surface of the second platform is above the upper surface of the first support platform.

24. The exercise machine of claim 1, wherein the first support structure and the second support structure distally spaced apart from one another and are not connected directly to one another.

25. The exercise machine of claim 1, wherein the first support structure and the second support structure distally spaced apart from one another and are individually movable toward or apart from one another along an axis traverse to the longitudinal axis of the base structure.

26. The exercise machine of claim 1, wherein the frame is movably connected to a base.

27. The exercise machine of claim 26, wherein the first end of the frame is adapted to be elevated and lowered by an actuator about a pitch axis.

28. The exercise machine of claim 27, wherein the frame is adapted to be rotated about a roll axis.

29. The exercise machine of claim 1, wherein the frame is non-movably attached to a base.

30. The exercise machine of claim 1, wherein the biasing member is comprised of a spring.

31. The exercise machine of claim 1, wherein the first support structure and the second support structure mirror one another.

32. The exercise machine of claim 1, wherein the upper surface of the first support platform includes a first portion that is substantially parallel with respect to the longitudinal axis of the exercise machine.

33. The exercise machine of claim 1, wherein the first support platform is aligned with the upper handle.

34. The exercise machine of claim 1, wherein the first support platform, the upper handle and the first handle are aligned with respect to one another.

35. An exercise machine with multiple contact surfaces, comprising:

a frame having a first end, a second end and a longitudinal axis, wherein the frame includes a rail;

a first stationary platform connected to the frame near the first end, wherein the first stationary platform is configured to support a body part of an exerciser;

a second stationary platform connected to the frame near the second end, wherein the second stationary platform is configured to support a body part of an exerciser;

a carriage movably connected to the rail, wherein the carriage is movable between the first end and the second end of the rail and wherein the carriage has an upper surface;

a biasing member connected to the carriage, wherein the biasing member is adapted to provide a biasing force to the carriage; and a first support structure and a second support structure attached to the frame near the first end, wherein the first support structure and the second support structure are positioned on opposing sides of the frame and extend upwardly from the frame, wherein the first support structure and the second support structure each include a plurality of surfaces at different angles relative to the longitudinal axis configured to simultaneously support multiple surfaces of the exerciser, wherein the first support structure and the second support structure are each configured to provide a plurality of locations to grasp by the exerciser and wherein the first support structure and the second support structure each include a first support platform having an upper surface configured to support the wrists of the exerciser, wherein the upper surface of the first support platform is positioned above the upper surface of the carriage;

wherein the upper surface of the first support platform is stationary;

wherein the upper surface of the first support platform is elongated and narrow, wherein the upper surface of the first support platform has a length and a width, wherein the length of the upper surface of the first support platform is greater than the width of the first support platform;

wherein the first stationary platform is positioned between the first support structure and the second structure;

wherein the first support structure and the second support structure each include a first handle, wherein the first handle is positioned below the upper surface of the first support platform;

wherein the first support structure and the second support structure each include an upper handle that extends upwardly from the first support platform.

36. The exercise machine of claim 35, wherein the upper surface of the first support platform is straight.

37. The exercise machine of claim 35, wherein the upper surface of the first support platform is planar.

38. The exercise machine of claim 35, wherein the first support structure and the second support structure distally spaced apart from one another and are not connected directly to one another.

39. The exercise machine of claim 35, wherein the frame is movably connected to a base.

40. The exercise machine of claim 39, wherein the first end of the frame is adapted to be elevated and lowered by an actuator about a pitch axis.

41. The exercise machine of claim 39, wherein the frame is adapted to be rotated about a roll axis.

42. The exercise machine of claim 35, wherein the first support structure and the second support structure mirror one another.

43. The exercise machine of claim 35, wherein the upper surface of the first support platform includes a first portion that is substantially parallel with respect to the longitudinal axis of the exercise machine.

44. The exercise machine of claim 35, wherein the first support platform is aligned with the upper handle.

45. The exercise machine of claim 35, wherein the first support platform, the upper handle and the first handle are aligned with respect to one another.

46. An exercise machine with multiple contact surfaces, comprising:

a frame having a first end, a second end and a longitudinal axis, wherein the frame includes a rail;

a first stationary platform connected to the frame near the first end of the frame, wherein the first stationary platform is configured to support a body part of an exerciser;

a second stationary platform connected to the frame near the second end of the frame, wherein the second stationary platform is configured to support a body part of an exerciser;

a carriage movably connected to the rail, wherein the carriage is movable between the first end and the second end of the rail and wherein the carriage has an upper surface;

a biasing member connected to the carriage, wherein the biasing member is adapted to provide a biasing force to the carriage; and a first support structure and a second support structure attached to the frame near the first end, wherein the first support structure and the second support structure are positioned on opposing sides of the frame and extend upwardly from the frame, wherein the first support structure and the second support structure each include a plurality of surfaces at different angles relative to the longitudinal axis configured to simultaneously support multiple surfaces of the exerciser, wherein the first support structure and the second support structure are each configured to provide a plurality of locations to grasp by the exerciser and wherein the first support structure and the second support structure each include a first support platform having an upper surface configured to support the wrists of the exerciser, wherein the upper surface of the first support platform is positioned above the upper surface of the carriage;

wherein the upper surface of the first support platform is stationary;

wherein the upper surface of the first support platform is elongated and narrow, wherein the upper surface of the first support platform has a length and a width, wherein the length of the upper surface of the first support platform is greater than the width of the first support platform;

wherein the first stationary platform is positioned between the first support structure and the second structure;

wherein the first support structure and the second support structure each include a first handle, wherein the first handle is positioned below the upper surface of the first support platform;

wherein the first support structure and the second support structure each include an upper handle that extends upwardly from the first support platform.

47. The exercise machine of claim 46, wherein the upper surface of the first support platform is straight.

48. The exercise machine of claim 46, wherein the upper surface of the first support platform is planar.

49. The exercise machine of claim 46, wherein the first support structure and the second support structure distally spaced apart from one another and are not connected directly to one another.

50. The exercise machine of claim 46, wherein the frame is movably connected to a base.

51. The exercise machine of claim 50, wherein the first end of the frame is adapted to be elevated and lowered by an actuator about a pitch axis.

52. The exercise machine of claim 50, wherein the frame is adapted to be rotated about a roll axis.

53. The exercise machine of claim 46, wherein the first support structure and the second support structure mirror one another.

54. The exercise machine of claim 46, wherein the upper surface of the first support platform includes a first portion that is substantially parallel with respect to the longitudinal axis of the exercise machine.

55. The exercise machine of claim 46, wherein the first support platform is aligned with the upper handle.

56. The exercise machine of claim 46, wherein the first support platform, the upper handle and the first handle are aligned with respect to one another.

* * * * *